US007318797B2

(12) United States Patent
Buhl et al.

(10) Patent No.: US 7,318,797 B2
(45) Date of Patent: Jan. 15, 2008

(54) CONTINUOUS ROD MACHINE ARRANGEMENT FOR PRODUCING NONWOVEN FILTERS

(75) Inventors: Alexander Buhl, Robertsdorf (DE); Jann DeBoer, Hamburg (DE); Sönke Horn, Geesthacht (DE); Irene Maurer, Hamburg (DE); Thorsten Scherbarth, Geesthacht (DE); Stephan Wolff, Glinde (DE); Peter-Franz Arnold, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 11/214,934

(22) Filed: Aug. 31, 2005

(65) Prior Publication Data

US 2006/0010654 A1 Jan. 19, 2006

Related U.S. Application Data

(62) Division of application No. 10/815,933, filed on Apr. 2, 2004.

(30) Foreign Application Priority Data

Apr. 3, 2003 (EP) ..... 03007672
Jul. 7, 2003 (EP) ..... 03015325

(51) Int. Cl.
*B31C 13/00* (2006.01)

(52) U.S. Cl. ..... 493/44; 493/46; 493/48; 493/50

(58) Field of Classification Search ..... 493/39, 493/44, 45, 46, 47, 48, 50
See application file for complete search history.

(56) References Cited

U.S. PATENT DOCUMENTS

| | | | | |
|---|---|---|---|---|
| 2,796,810 | A | | 6/1957 | Müller |
| 3,050,427 | A | * | 8/1962 | Slayter et al. ..... 442/370 |
| 3,171,151 | A | * | 3/1965 | Sickle et al. ..... 15/118 |
| 3,644,078 | A | | 2/1972 | Tachibana et al. |
| 3,834,869 | A | * | 9/1974 | Ancelle et al. ..... 8/151 |
| 3,847,064 | A | * | 11/1974 | Berger ..... 493/44 |
| 4,020,751 | A | * | 5/1977 | Greve et al. ..... 493/41 |
| 4,640,810 | A | | 2/1987 | Laursen et al. |

(Continued)

FOREIGN PATENT DOCUMENTS

DE 33 01 031 C2 2/1993

(Continued)

OTHER PUBLICATIONS

European Search Report dated Aug. 4, 2006, issued in EP 06 01 1475.

(Continued)

*Primary Examiner*—Sameh H. Tawfik
(74) *Attorney, Agent, or Firm*—Venable LLP; Robert Kinberg; Catherine M. Voorhees

(57) ABSTRACT

The invention relates to a method for producing a nonwoven fiber composite for the manufacture of filters in the tobacco industry, wherein the method feeds separated fiber materials to a fluidized bed and the separated filter material inside the fluidized bed are transported to a rod-forming device, essentially by a transport air flow flowing in the direction of the rod-forming device and the filter material is compiled on the rod-forming device prior to forming the compacted fiber filter elements.

13 Claims, 17 Drawing Sheets

U.S. PATENT DOCUMENTS

| | | | | |
|---|---|---|---|---|
| 4,673,136 | A | 6/1987 | Bianco et al. | |
| 6,371,126 | B1 * | 4/2002 | Korte et al. | 131/110 |
| 2003/0213496 | A1 | 11/2003 | Wolff et al. | |

FOREIGN PATENT DOCUMENTS

| | | | |
|---|---|---|---|
| DE | 102 17 410 | A1 | 10/2003 |
| EP | 0 546 519 | A | 6/1993 |
| EP | 0 616 056 | B1 | 9/1994 |
| EP | 1 354 522 | A2 | 10/2003 |
| GB | 718332 | | 11/1954 |
| GB | 2 101 642 | A | 1/1983 |
| GB | 2 165 136 | A | 4/1986 |
| WO | WO 01/54873 | A1 | 8/2001 |
| WO | WO 03/016137 | A1 | 2/2003 |

OTHER PUBLICATIONS

Third Party Remarks Concerning the Patentability of European Patent 0611475.8 dated May 17, 2007.

* cited by examiner

CONTINUOUS ROD MACHINE ARRANGEMENT FOR PRODUCING NONWOVEN FILTERS

CROSS REFERENCE TO RELATED APPLICATIONS

This application is a divisional of U.S. application Ser. No. 10/815,933 filed on Apr. 2, 2004, which claims the priority of European Applications Nos. 03 007 672.3 filed Apr. 3, 2003 and 03 015 325 filed Jul. 7, 2003.

BACKGROUND OF THE INVENTION

The invention relates to a method for producing nonwoven fiber material for the manufacture of filters in the tobacco industry. The invention furthermore relates to a continuous rod machine for use in the tobacco industry, comprising at least one filter-material feeding device that supplies metered amounts of filter material and a continuous rod forming device in which the filter material can be formed and in particular compiled into a continuous rod.

A method for producing a nonwoven fiber composite and a corresponding continuous rod machine for the manufacture of filters in the tobacco industry is known from British patent document GB 718 332. According to this document, material cuttings are produced with a tobacco cutter and these are fed to a continuous-rod machine, such as cigarette rod machines. The cuttings are impregnated with a chemical agent to prevent an undesirable taste and to prevent them from falling out of the end pieces of the respectively produced filters The cuttings are conveyed with a roller to the operating range of a spiked feed roller and are then moved with the spiked feed roller to a conveying belt, so that they can subsequently be fed to a different spiked roller. The cuttings are then knocked from this spiked feed roller by a different spiked or beater roller and supplied to a format device where the continuous filter rod is formed by wrapping a material web around the fiber rod. The cuttings consist of paper, cellulose, textile, synthetic materials and the like and have a texture that is similar to cut tobacco.

The shape of the cuttings makes it very difficult to produce filters with homogeneous characteristics. In addition, the options of adjusting the filter characteristics are very limited.

SUMMARY OF THE INVENTION

In contrast, it is the object of the present invention to provide a method for producing a nonwoven filter material for the manufacture of filters in the tobacco industry, as well as a generic continuous rod machine, by means of which extremely homogeneous filters can be produced and a high variability of the characteristics of the filter to be produced is possible.

This object is solved by using a fluidized bed for the production of filters in the tobacco industry. The fluidized bed, which can also be called a fluidized bed distributor, can be used easily and purposely for conveying metered filter material, in particular separated filter material, in the direction of a continuous rod machine, wherein an extremely uniform conveying is possible, thus producing filters with high homogeneity.

If the fluidized bed is arranged upstream of a continuous rod machine, in conveying direction of the filter materials, and the fluidized bed comprises a curved wall that guides the filter materials, it is particularly easy to separate the used transport air flow from the filter material. As a result, it is possible to achieve extremely good continuous rod characteristics for the compiled filter materials in the continuous rod forming device, thus resulting in a homogeneous filter. It is advantageous if the curved wall of the fluidized bed initially points downward, then changes over to the horizontal position and finally is directed upward.

The object is furthermore solved with a method for producing a nonwoven fiber composite for the manufacture of filters in the tobacco industry, wherein the method feeds separated fiber materials to a fluidized bed and the separated filter material inside the fluidized bed are transported to a rod-forming device, essentially by a transport air flow flowing in the direction of the rod-forming device and the filter material is compiled on the rod-forming device prior to forming the compacted fiber filter elements.

Particularly suitable as a continuous rod machine is a continuous rod conveyor, which comprises an air-permeable conveying medium, e.g. a conveying belt.

The method according to the invention makes it possible to produce an extremely homogeneous nonwoven fiber composite for the manufacture of filters in the tobacco industry. Thus, the filters produced from this nonwoven fiber composite are also very homogeneous. A high degree of variability of the filter characteristics can furthermore be adjusted if the filter material includes fibers.

Extremely homogeneous filter characteristics can be obtained by using compiled, woven or nonwoven finite fiber material ("finite fiber(s)") as filter material and by essentially completely separating the fibers prior to forming a continuous rod from which the individual filters are subsequently formed. The essentially complete separation of the finite fibers, in particular, is extremely important since only separated fibers, which are subsequently reshaped into a nonwoven fiber composite, allow the forming of a nonwoven filter with an essentially uniform and homogeneous density.

The flow of separated finite fibers resembles the image of a snow storm, meaning it is a flow of fibers with a homogeneous static distribution of the fibers with respect to space and time. In particular, the complete separation of the fibers means that essentially there are no more connecting groups of fibers. A composite fiber material, for example with a nonwoven fiber structure, is created only after the fibers are separated. By breaking up the fiber groups and separating the fibers into individual fibers, a nonwoven fiber composite can be formed that does not contain bridge-type connections and cavities.

If the separated fibers are transported at least in part by means of an air flow, the separated fibers can be transported without forming fiber groups. For one particularly preferred embodiment of the method according to the invention, the fibers are separated at least in part with the aid of an air flow, thus resulting in an extremely high degree of separation. A large volume of air is used to help separate the fibers. Excess air is then removed at least partially from the fiber flow in the region of a fluidized bed.

A high degree of separation is possible if the fibers are separated at least in part while passing through the openings of a device provided with a plurality of openings. Pre-separated fibers remain essentially separated during the feeding operation if the fibers are supplied at least in part with an air flow. The separated fibers and also the fiber groups that are processed prior to the essentially complete separation of the fibers are primarily supplied only with transport air and/or an air flow.

A higher degree of fiber separation is achieved if at least two separation steps are used. Finite composite fibers are preferably pre-separated by using a hammer crusher or a bale breaker. A hammer crusher is used to break up a fiber felt while a bale breaker is used to break up a fiber bale.

At least one metering step is provided according to one preferred modification of the method according to the invention, by means of which the fiber amount, in particular, can be metered out. A pre-metering and/or a primary metering can be provided for this. A rough adjustment of the throughput rate of the fibers to be processed is possible with the pre-metering, whereas a more precise adjustment is possible with the primary metering.

A particularly efficient and quick process sequence is possible if at least one metering step occurs at the same time as a separation step.

Different types of fibers are preferably used, so that filters with different filtering characteristics can be produced. Cellulose acetate, cellulose, carbon fibers and multi-component fibers, especially bi-component fibers, for example, can be considered for the fiber materials. With respect to the components in question, reference is made in particular to German patent document DE 102 17 410.5 commonly owned by the assignee of this application. DE 102 17 410.5 corresponds to U.S. 2003/0213496 A1.

The different fiber types are advantageously mixed together, wherein at least one additive can be mixed in. In particular, the additive can be a bonding agent such as latex or a granulated material that is particularly effective for binding cigarette-smoke components, e.g. activated carbon granulate.

According to one particularly preferred embodiment of the method according to the invention, a complete fiber separation takes place along with or following a second or third metering step, wherein the separation following a third metering step in particular is possible with a pre-metering step.

It is particularly preferable if the fiber length is shorter than the length of the filter to be produced. With respect to the filter length, reference is also made German patent document DE 102 17 410.5 commonly owned by the assignee of the present application, the content of which is incorporated herein by reference. It is preferred that the fiber length be between 0.1 mm and 30 mm and, in particular, between 0.2 mm and 10 mm. The filter to be produced has a standard cigarette-filter length and/or filter segment length in case of multi-segment cigarette filters. An extremely homogeneous filter based on the processing according to the invention can be produced if the average fiber diameter is additionally in the range of 10 to 40 μm, particularly 20 to 38 μm and especially preferred between 30 and 35 μm.

It is preferable if a method for producing filters, involving a process according to the invention for processing filter material as described herein, is provided which additionally is used for forming a continuous fiber rod and dividing the continuous fiber rod into individual filter rods, such as used in the tobacco industry.

According to the method for producing filters in the tobacco industry, a nonwoven filter is preferably formed from the separated finite fibers no later than during the forming of the continuous rod. To form this continuous rod of finite fibers, the fibers are transported in a continuous flow to a suction belt conveyor, thus forming a nonwoven fiber composite on the surface of the suction belt conveyor. The suction belt conveyor is specifically designed to keep the finite fibers, e.g. with a relatively small diameter, on the suction belt. Essentially, the continuous rod is formed in the same way as a continuous tobacco rod. However, respective measures and variations are introduced for turning the finite fiber material, which differs in size and structure as compared to tobacco fibers, into a homogeneous continuous rod. Reference is made here in particular to European Patent Application No: EP 03 007 675.6, filed on Apr. 3, 2003 and entitled "VERFAHREN UND EINRICHTUNG ZUR HERSTELLUNG EINES FILTERSTRANGS" [Method and Machine for Producing a Continuous Filter Rod], commonly owned by the assignee of the present application.

Different types of filter materials are preferably supplied successively in the transport direction of the filter materials to the fluidized bed, so that a homogeneous mixing is achieved. In addition, this permits the feeding of many different types of filter materials. According to one particularly preferred embodiment of the method according to the invention, the filter material is separated during the feeding process. In particular, a transport air flow that flows through the fluidized bed is used for this. This transport air flow can flow past an apparatus for feeding filter material to the fluidized bed, which causes filter material to be separated out of this conveying element and/or feeding element. The filter material supplied by the feeding element can be pre-separated completely or only partially ahead of time, e.g. such as filter material broken or torn by a bale breaker from the bale.

According to the invention, the method for producing filters for use in the tobacco industry involves a method for producing a nonwoven fiber composite, as described herein, wherein the nonwoven composite is additionally changed into a continuous filter rod and the rod is then divided into filter rod sections.

The object is furthermore solved with an arrangement of a continuous rod machine for use in the tobacco industry, comprising at least one filter-material feeding device which comprises a metering element for dispensing metered amounts of separated filter material, a continuous-rod forming device, and a fluidized bed for transporting the filter material from the filter material feeding device to the continuous rod-forming device.

The continuous rod machine according to the invention makes it possible to produce filters with extremely homogeneous characteristics. The continuous rod machine can produce homogeneous filter rods without many involved separating devices if the filter material feeding device is designed to supply filter material with the aid of at least one conveying element, in particular a roller, from a filter material supply to the fluidized bed. A transport air flow and/or conveying air flow preferably serves to remove and separate the filter materials supplied by the conveying element to the fluidized bed. Thus, the filter material feeding device also meets a separating function.

Separated fibers or essentially separated fibers can preferably be supplied to the fiber material supply, so that no further separating step for feeding the filter material is required. In addition, the feeding of separated fibers results in the production of an extremely homogeneous filter rod with good filter characteristics. According to one preferred embodiment of the invention, a channel is installed upstream of the continuous rod device and follows the fluidized bed downstream in filter material conveying direction. As a result of this design of the continuous filter rod machine, the supplied filter material essentially does not lose its homogeneity and/or no final mixing of the different filter materials occurs in conveying the material after the fluidized bed.

It is preferable if the fluidized bed, at least in part, takes the form of a channel. A very simple and effective control of the amount of conveyed composite material in the fluidized bed can be achieved if the fluidized bed is curved in the conveying direction of the filter material, such that the fluidized bed initially points downward, then levels off to become horizontal and finally points in upward direction. In this case, only the amount of transport air and/or the strength of the transport air needs to be adjusted and/or controlled. Preferably, the fluidized bed has an elliptical shape, for which the curvature increases in the downstream transporting direction. In general, the fluidized bed can be a fluidized bed such as the one described in German patent document DE 33 01 031 C2, the contents of which are hereby incorporated by reference.

For a particularly preferred embodiment of the continuous rod machine according to the invention, the filter material feeding device comprises a separating device that separates a nonwoven of a starting material into individual fibers. In that case, cellulose fibers can easily be used for the filter production. The separating device advantageously uses a fiber crusher that comprises a cutting drum or a hammer crusher. A fiber crusher of this type is produced, for example, by the company Diatec.

The filter material is preferably metered via the filter material feed to the separating device. For this, the filter material is initially present in the form of a nonwoven composite or mass. In this instance, the advance of the nonwoven material to the separating device controls the metering of the filter material which is supplied to the fluidized bed.

According to one particularly preferred embodiment of the invention, at least two filter material feeding devices are provided, which require two different filter material feeding devices, wherein one device comprises a fiber crusher, for example, and the other one a conveying element that conveys fibers from a fiber supply, containing essentially separated fibers, to a fluidized bed. Additional fiber material feeding devices can also be provided, e.g. for feeding granulate and particularly activated carbon granulate to the fluidized bed. With respect to the fiber crusher, U.S. Pat. No. 4,673,136 A, describes a fiber crusher of suitable type.

The object is furthermore solved with an arrangement for processing filter material for use in the manufacture of filters in the tobacco industry, wherein the arrangement comprises at least one device for separating the filter material and at least one metering device. At least one means for supplying the filter material from the at least one metering device to the at least one separating device is also provided, wherein the processing arrangement is modified for processing filter material with finite fibers and wherein the at least one device for separating the finite fibers permits an essentially complete separation.

A filter having extremely homogeneous characteristics can be realized with the arrangement according to the invention and correspondingly processed filter material.

The feeding means preferably comprise an air flow, which makes it possible to produce an even more homogeneous filter.

One particularly preferred embodiment of the arrangement according to the invention for processing fibers requires an air flow through and/or in the arrangement for separating the fibers, which results in a high degree of separation. The separating device of a particularly effective processing arrangement is provided with a plurality of openings through which the separated fibers can individually exit the device.

A particularly easy to realize metering device comprises a drop chute from which a rotating roller removes the fibers. If a pair of feed rollers are provided in the lower region of the metering device, the filter material can be metered out in a careful manner.

A particularly good and homogeneous separation occurs if the separating device separates the fibers through a joint operation of at least one rotating element, at least one element provided with passages and an air flow. The metering device and/or the at least one metering device preferably also has a separating function, which can further increase the degree of separation of the complete processing arrangement. Different materials and also different fibers can be processed if a mixing device is preferably provided, wherein the fibers can be cellulose fibers, fibers of a thermoplastic strength, flax fibers, hemp fibers, linseed fibers, sheep's wool fibers and cotton fibers or can be multi-component fibers, as previously shown in the above. The mixing device preferably permits an additional separation and/or metering of the fibers, thus making possible an extremely compact arrangement design. The arrangement for one particularly preferred embodiment of the invention is designed such that finite fibers with a length shorter than that of the filter to be produced can be processed. The arrangement is furthermore designed for processing natural finite fibers with an average fiber diameter in the range of 10 to 40 μm, in particular 20 to 38 μm, wherein a particularly preferred diameter is in the range of 30 to 35 μm. The fiber strength of synthetic fibers is between 1 and 20 dtex, in particular between 2 to 6 dtex.

According to the invention, a filter production machine comprises a processing arrangement as described in the above.

A filter according to the invention is produced with one of the above-described methods.

BRIEF DESCRIPTION OF THE DRAWINGS

The invention is described in the following by referring to the drawings, to which we otherwise refer with respect to all details not mentioned specifically in the text.

Shown are in.

DETAILED DESCRIPTION OF THE DRAWINGS

Figure 1:
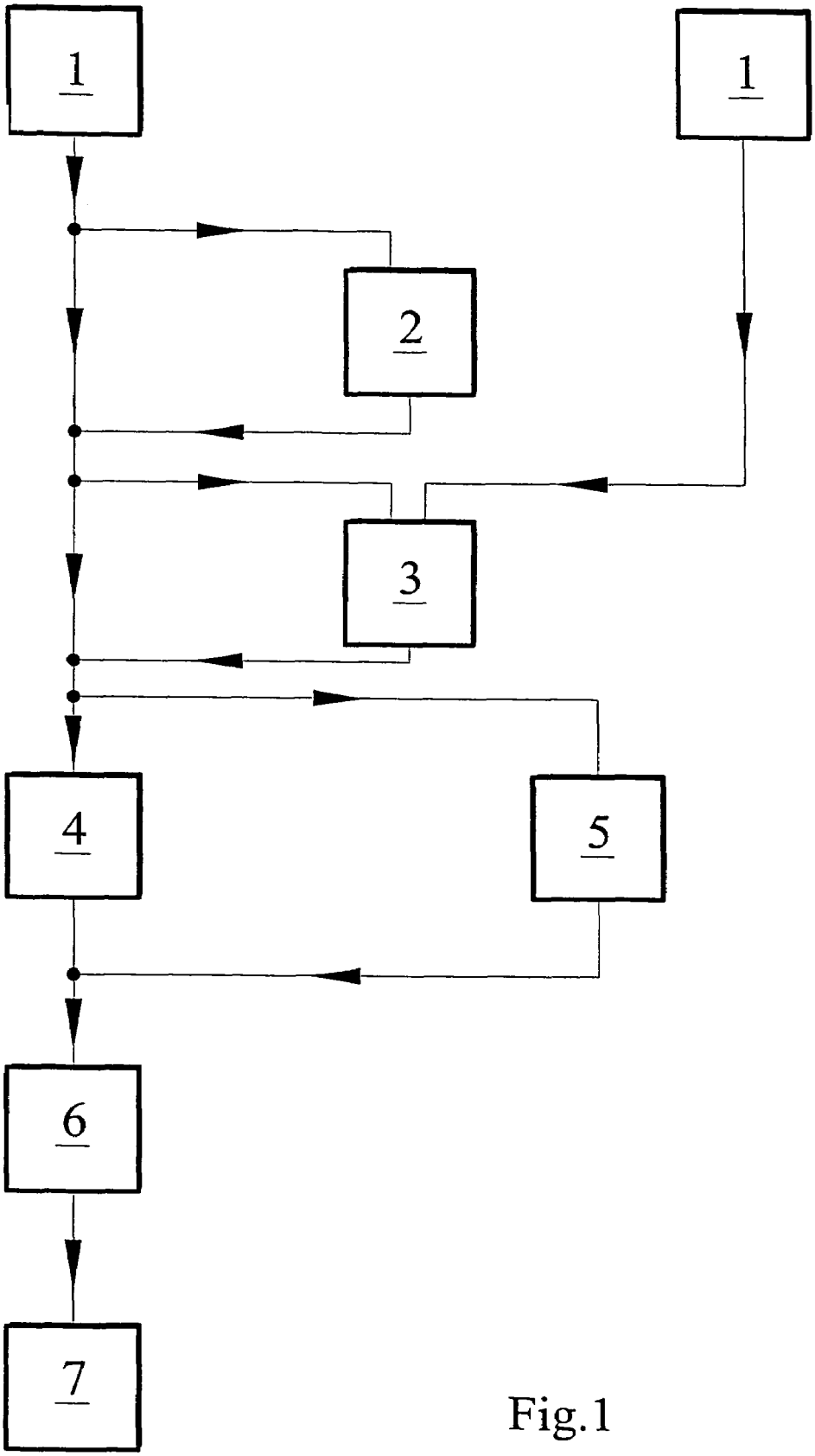
FIG. 1 is a schematic block diagram of the several sequences for processing filter material.
Figure 2:
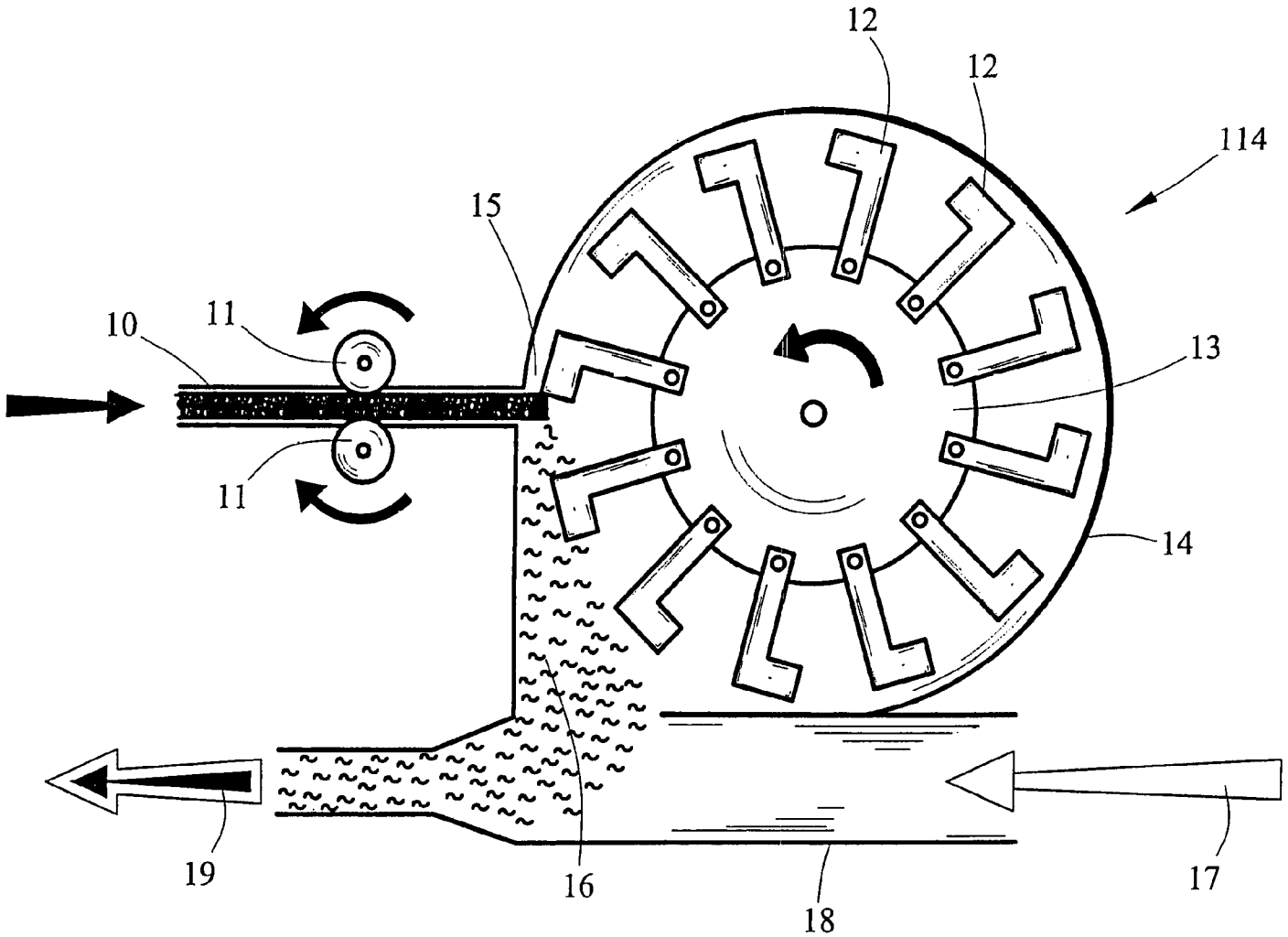
FIG. 2 is a schematic cross-sectional side view representation of one arrangement for the separation of filter material from a mass of filter material.

FIG. 1 is a block diagram of the method steps, ranging from a fiber processing to a continuous rod production, for producing a filter for use in the tobacco industry. A variable process sequence is possible owing to the different types of process sequences that can be used. The example in FIG. 1 shows initially a fiber preparation step 1, during which above all the fiber materials that are delivered in a solidly compressed form are changed to an airy-cottony state. Individual fibers can also be generated in addition to these fiber groups. The fiber preparation 1 is realized, for example, with an arrangement as shown in FIG. 2, which is known per se. The forms that solidly compressed fiber 10 may be delivered include, for example, fiber bales and fiber mats as well as fiber felt. Fiber bales are normally opened with a bale breaker and fiber mats and/or fiber felt are opened with a hammer crusher.

Non-compressed fiber materials that are densely packaged are also loosened up during the fiber preparation stage and puffed up to form an airy, cottony state. A bale breaker for fiber materials can be purchased, for example, from the company Trützschler GmbH, Germany and a hammer crusher for fiber materials can be purchased from the company Kamas.

A pre-metering step 2, which can optionally be used with this exemplary embodiment, can represent a second step. The arrangement according to FIG. 3 permits a pre-metering step 2, wherein the pre-metering functions to roughly batch the fiber material and further separate it, such that the groups and/or the densely packed fibers are further loosened up, wherein additional separated fibers can develop at this point as well. In place of the pre-metering step 2, it is also possible to realize a primary metering and/or metering step 4 by itself The condition of the material received from the fiber preparation 1 determines whether a pre-metering 2 step is required. The goal of the metering 4 and/or the pre-metering 2 is to realize a defined, stable and uniform mass flow of fibers and additionally, in part, also a pre-separation. The metering step 4 leads to a further separation of the fiber groups. Prior to the metering step 4, a mixing and/or metering step 3 can also be provided. During this step 3, several filter materials, as indicated in FIG. 1 with the paths from two or more fiber processors 1 leading to the box 3, and if necessary an additive, such as a bonding agent or activated carbon granulate, can also be mixed in.

Figure 4:
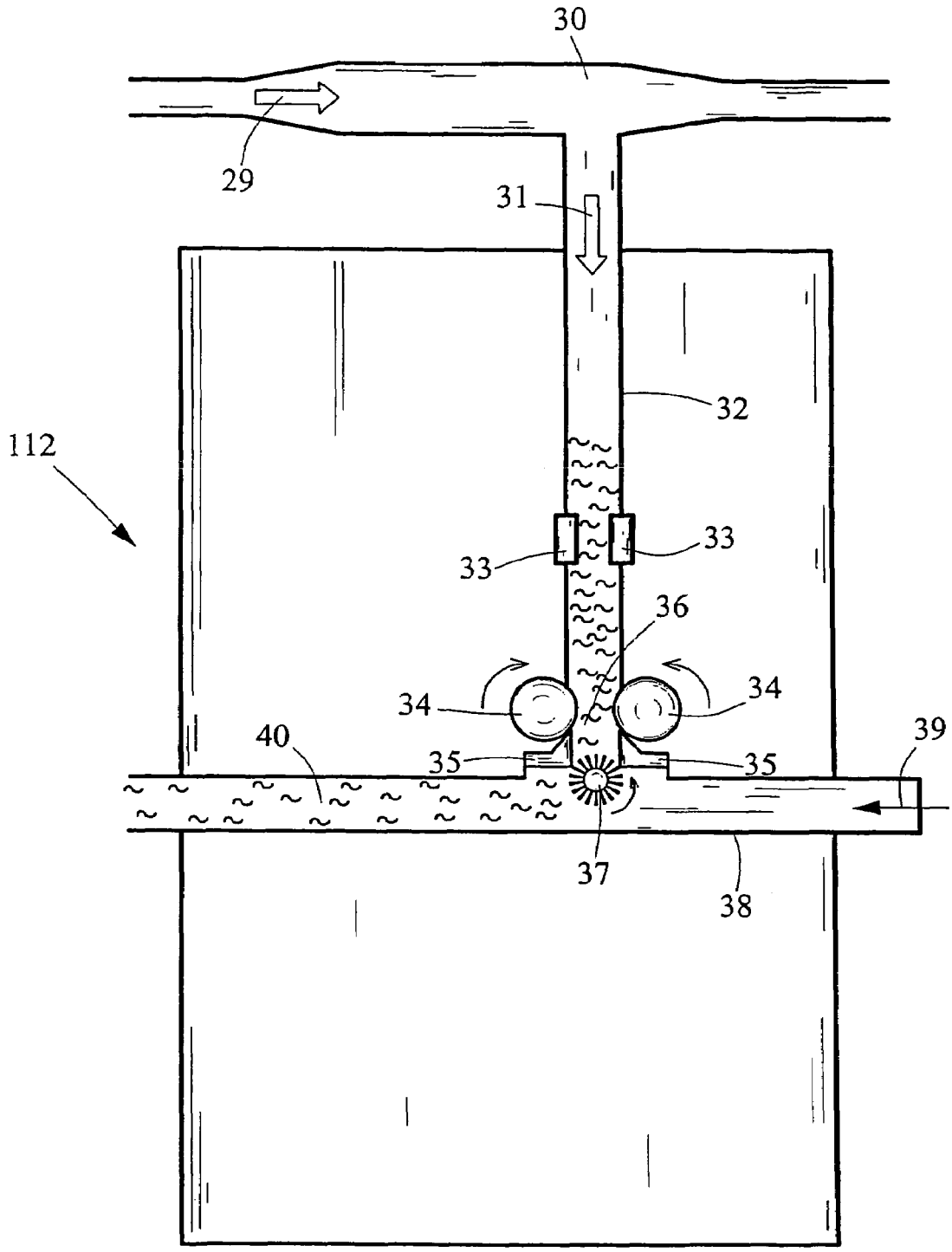
FIG. 4 is a schematic cross-sectional side view representation of one embodiment of a primary metering device for the controlled metering of material.
Figure 5:
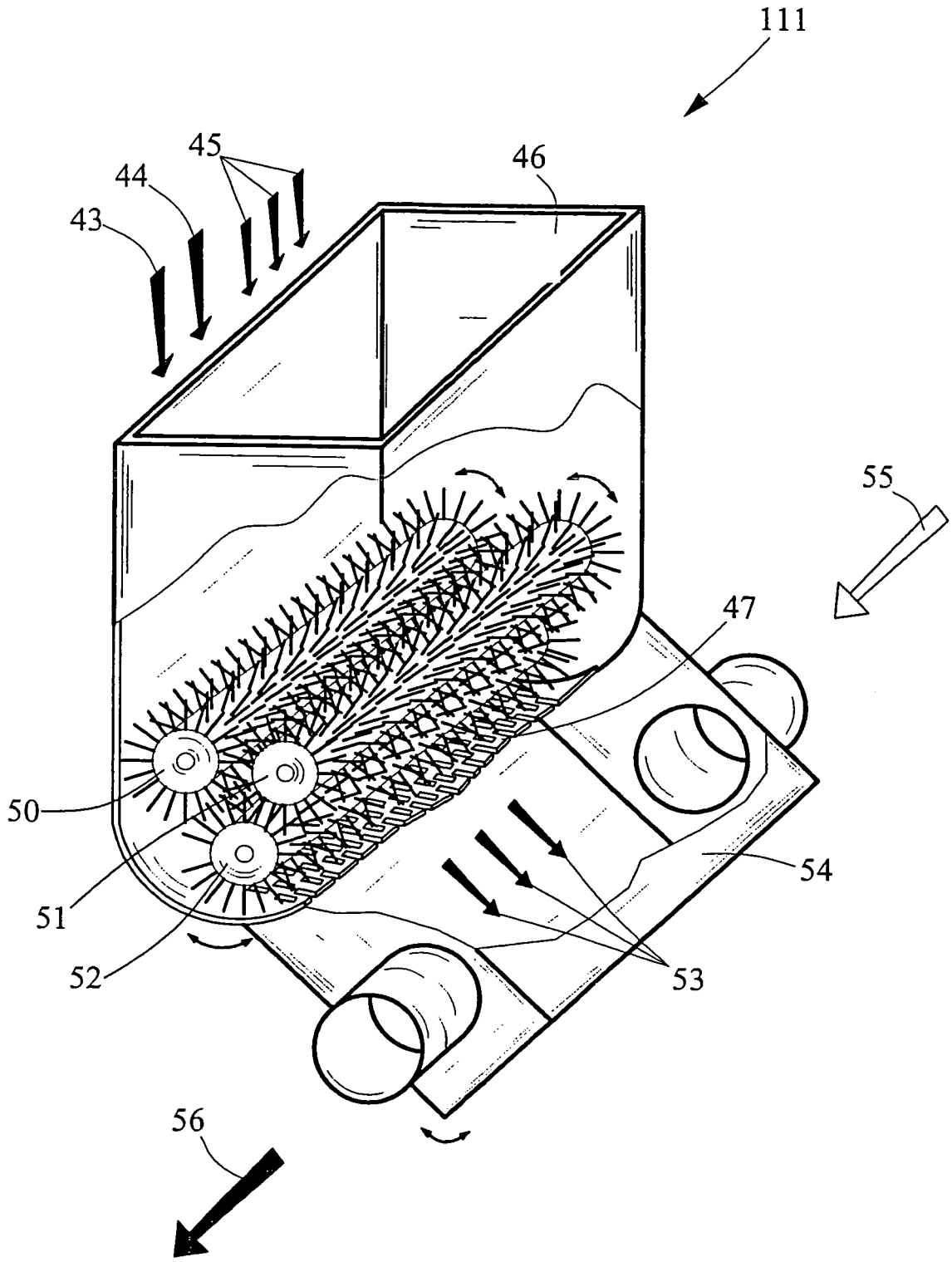
FIG. 5 is a three-dimensional schematic representation of a mixing device for the mixing of different filter materials.

The method can furthermore be realized with differently configured and/or identically configured in parallel processing and metering lines, so that several different types of fiber materials can be processed and metered in parallel. The goal of the mixing operation is to achieve a homogeneous mixing of the individual fiber components and the different additives. A device as shown in FIG. 5 can be used for the mixing and/or metering. A primary metering step, for example, can be realized with a device as shown in FIG. 4.

During the mixing and/or metering step, the different fiber materials can be mixed continuously or discontinuously. A continuous mixing device 111, for example, is shown in FIG. 5, wherein the mixing device 111 also functions as intermediate storage for fiber materials. Not only is it possible to mix different fibers during this mixing and/or metering step, but additives can also be mixed in. These additives serve to bond together the fibers and/or to influence the filtration characteristics of the fiber filter.

The discharge from the mixing device 111 is defined, which results in a metering function. It may be possible to omit the primary metering 4 by using a mixing and/or metering 5. Following the metering 4 stage or the mixing and/or metering 5 stage, the fiber material is fed to a separating step 6. The goal for the separating is a total break-up of the remaining fiber groups into individual fibers, so that the fibers can be regrouped in a following continuous rod production step 7, such that an optimum nonwoven fiber structure without bridge-type connections and cavities can develop. It is important in this connection that an individual fiber can fit itself against other fibers to form a nonwoven structure. Thus, according to FIG. 1, it is possible to use up to three metering steps. Additional metering stages can also precede the initial separation process 1.

The fiber flow leaving the separating device(s) consists of individual fibers carried along by air and/or in an air flow. The appearance of the air flow carrying along fibers or a fiber-loaded air flow resembles a snow storm. For producing a continuous rod from the separated fibers, the fibers can be supplied, for example with a fluidized bed, to a suction belt of a special suction-belt conveyor. During the forming of the continuous rod 7, a continuous rod with constant cross section is created, wherein the cross section in particular has a constant square shape and a uniform density is created at the same time. The fibers are present in a nonwoven form at least up to the rod formation. The finished fiber filter rod has sufficient hardness, tensile resistance, weight consistency, retention and further processing ability.

FIG. 2 shows a fiber preparation arrangement 114. A fiber felt 10 is conveyed with feed rollers 11 to the operating range of a hammer crusher 13 with hammers 12. The hammers 12 of this hammer crusher 13 are located inside a housing 14. The hammers 12 hammer the fiber felt in the tear-off region 15, thus forming the fiber groups 16. The fiber groups 16 are transported further with an air flow 17 inside a pipe 18. An air flow 19 loaded with fiber groups is created. Individual fibers, not shown, can also be generated at this location. The hammers 12 of the hammer crusher 13 rotate in a downward direction so that the fibers are ejected in the direction of rotation of the crusher 13 and tangentially from housing 14.

Figure 3:
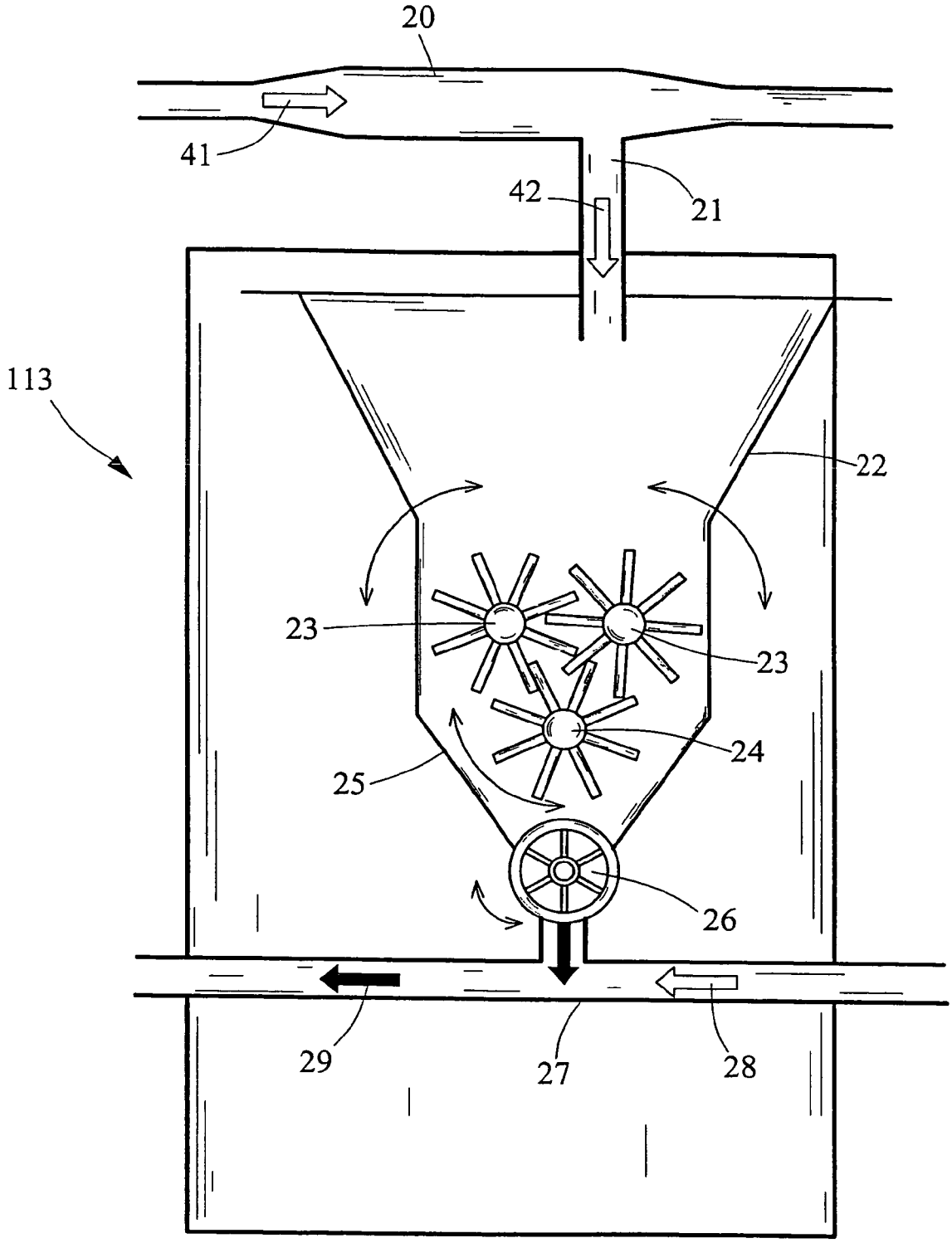
FIG. 3 is a schematic cross-sectional side view representation of one embodiment of a pre-metering device for the controlled metering of material.

A pre-metering device 113 is shown schematically in FIG. 3. An air flow loaded with fiber material 41 is supplied to a separator 20, which separates the fiber material 41 from the air flow so that the fiber material 42 drops through an chute 21 into a storage container 22. The lower part of the storage container 22 houses two spiked feed rollers 23. The spiked feed rollers 23 rotate slowly and deliver the fiber material to a third spiked feed roller 24. The third spiked feed roller 24 rotates quickly and tears fiber groups from the fiber material. These fiber groups travel to a funnel 25 by sliding downward. A rotary vane feeder 26 is arranged at the lower end of the funnel 25. The fiber groups slide into the cells of the rotary vane feeder 26 and are moved into the channel 27. An air flow 28 flows inside a channel 27 and carries along the fibers and/or fiber groups delivered to the channel 27. The air flow 28 also carries along individual fibers returned from the process, which are then supplied along with the fiber groups. The air flow 28 is loaded with fibers and fiber groups. A fiber/fiber group mixture 29 is transported with the aid of the air flow. The mass throughput can be adjusted by varying the speed of the rotating members, namely the spiked feed rollers 23 and 24 as well as that of the rotary vane feeder 26, so that a pre-metering can be realized.

FIG. 4 shows a schematic representation of a metering device 112 for realizing a primary metering operation. The fiber/fiber group mixture 29 is transported with an air flow to a separator 30, e.g. a rotary separator. There, the fiber/fiber group 31 is separated from the air flow, not shown. The separated out fiber material 31 travels to an accumulation chute 32 and drops downward through this chute to feed rollers 34. Several roller pairs or a pair of feed belts, not shown, and/or several feed belt pairs, not shown, can also be provided. Vibration elements 33 are provided for one section of the accumulation chute 32, which permit a continuous feeding of the fiber/fiber groups mixture 31 to the feed rollers 34.

The feed rollers 34 convey the fiber material 31 between the strippers 35 and into the metering channel 36 formed by the strippers. A rotating roller 37, e.g. a spiked feed roller, tears the fibers from the fiber material 31 and delivers these to a channel 38. An air flow 39 is present in the channel 38, which picks up the fibers and/or the fiber material 40 and correspondingly transports it in the direction of air flow 39. The fiber mass 31 flow, into the metering channel 36, is preset by the speed of the feed rollers 34.

FIG. 5 shows a three-dimensional, schematic representation of a mixing device 111. Different fiber materials 43 and 44 as well as additional fiber materials or additives 45 in liquid or solid phase are fed into a mixing chamber 46. The fiber materials can be cellulose fibers, fibers with a thermoplastic coating, flax fibers, hemp fibers, linseed fibers, sheep's wool fibers, cotton fibers or multi-component and in particular bi-component fibers, having a length shorter than the length of the filter to be produced and a thickness, for example, in the range of 25 to 30 μm. Cellulose fibers of the type "stora fluff EF untreated" by the company Stora Enso Pulp AB can be used, for example, which have an average cross section of 30 μm and a length of between 0.4 and 7.2 mm. For the synthetic fibers such as the bi-component fiber, it is possible to use fibers with a length of 6 mm of the type Trevira 255 3.0 dtex HM by the company Trevira GmbH. These fibers have a diameter of 25 μm. Cellulose acetate fibers, polypropylene fibers, polyethylene fibers and polyethylene terephthalat fibers can also be used for the synthetic fibers. Materials that influence the taste and/or smoke can furthermore be used as additives, such as activated carbon granulate or flavoring agents, as well as bonding agents that make the fibers stick together.

The fiber material 43 and 44 and/or the respective additives 45 that are fed into the mixing chamber 46 are supplied to rollers 50-52, which rotate with suitable speeds during the filling and the mixing operation. It is preferable if the position of rollers 50-52 can be adjusted in a horizontal as well as a vertical direction. As a result, the axial spacing, not shown, of the rollers can be adjusted relative to each other, wherein several rollers can furthermore be arranged on different levels. The components to be mixed are picked up by the rollers 50-52, are accelerated and churned up inside the mixing chamber 46. The churning causes the mixing of the components. The amount of time the mixing components spend inside the mixing chamber 46 can be adjusted with the geometric structure of a screen 47. In addition, the dwell time for the components to be mixed inside the mixing chamber 46 can be determined with a closing shutter (not shown) for closing the openings of the screen 47 partially or completely.

The fiber mixture and/or the fiber/additive mixture 53 is conveyed through openings of the screen 47 into a chamber 54, which can take place continuously or at intervals. An air flow 55 flows through the chamber 54, which preferably can pivot. The air flow 55 picks up the mixture 53 and pulls it along. The loaded air flow 56 leaves the chamber 54 and conveys the mixture 53 further.

Figure 6:
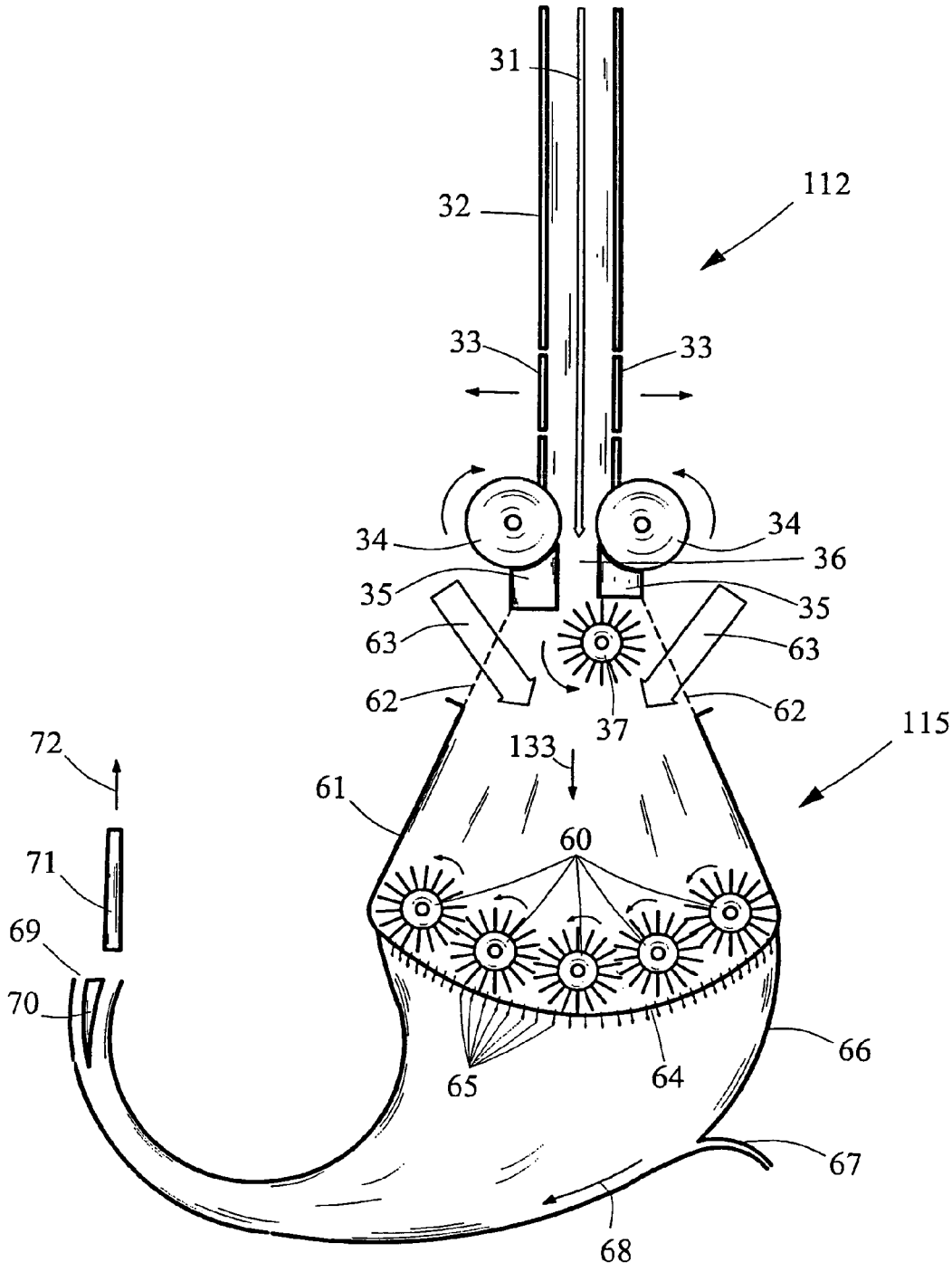
FIG. 6 is a schematic cross-sectional side view representation of one arrangement of a metering device containing a filter material separating device.

FIG. 6 shows a schematic representation of a separating device 115 in connection with a metering device 112. The metering device 112 essentially corresponds to the metering device shown in FIG. 4. However, the vibration elements 33 are shown as separate sections of the drop chute 32 and the strippers 35 differ slightly from those shown in FIG. 4. The fiber material, not shown, pulled from the metering channel 36 by the rotating roller 37 is fed directly to a separating chamber 61. The mass throughput in the metering channel 36 is determined by the speed of the feed rollers 34. Air flows through the complete separating device. This air flow 133 and 68 is generated by a reduced pressure caused on the one hand by an air flow 72 inside an exhaust pipe 71 and, on the other hand, by the flow in a suction belt conveyor that is arranged at a fluidized bed end 69 and is not shown in this FIG. The air flows 133 and 68 may also be augmented by an additional in-put of air.

Inside the separating chamber 61, the fibers and/or the fiber groups move under the effect of gravity and the influence of air flow 133 and/or the intake of air 63 through ventilation openings 62 to the region of rollers 60. The individual rollers 60 are aligned in the row and pick up the non-separated fibers (and of course also the partially separated fibers that are present), accelerate these fibers and beat these against a screen 64 of the separating chamber 61. Perforated sheets or round bar grids can also be used in place of a screen with exit surfaces.

As a result of mechanical stress, the fiber groups are separated into individual fibers and finally pass through the screen 64. Following a sufficient separation, the fibers are picked up by the flow 133 through the screen and are guided and/or suctioned through the screen 64. The speed of rollers 60 and the area of openings 64 as well as the intensity of the flow 133 determine the mass throughput of the separating chamber 61.

The separated fibers 65 travel to a fluidized bed 66 where they are picked up by an air flow 68 that can be augmented from an air nozzle, designed as a nozzle lip 67, and are moved along the fluidized bed 66. Several nozzle lips 67 can also be provided. The low pressure at the fluidized bed end 69 primarily ensures a sufficient flow 133 and 68 for transporting the separated fibers within chamber 61 and toward the fluidized bed end 69. At the fluidized bed end 69, the air flow 68 is, in part, separated from the fiber flow by a flow divider 70 and travels to the exhaust pipe 71. The flows 133 and 68, created by the low pressure and the nozzle lip 67, remove air from the separating chamber 61. Fresh air 63 flows through the ventilation openings 62 into the separating chamber 61.

The separated fibers, not shown, are transported in the fluidized bed region with the air flow 68, which includes air flow 133 previously used for the separation. This air flow moves in nearly a vertical direction until the fluidized bed is reached and subsequently moves along the fluidized bed. The flow 68 can be supplemented with additional air flows and/or air flow from one or more nozzles 67.

Figure 10:
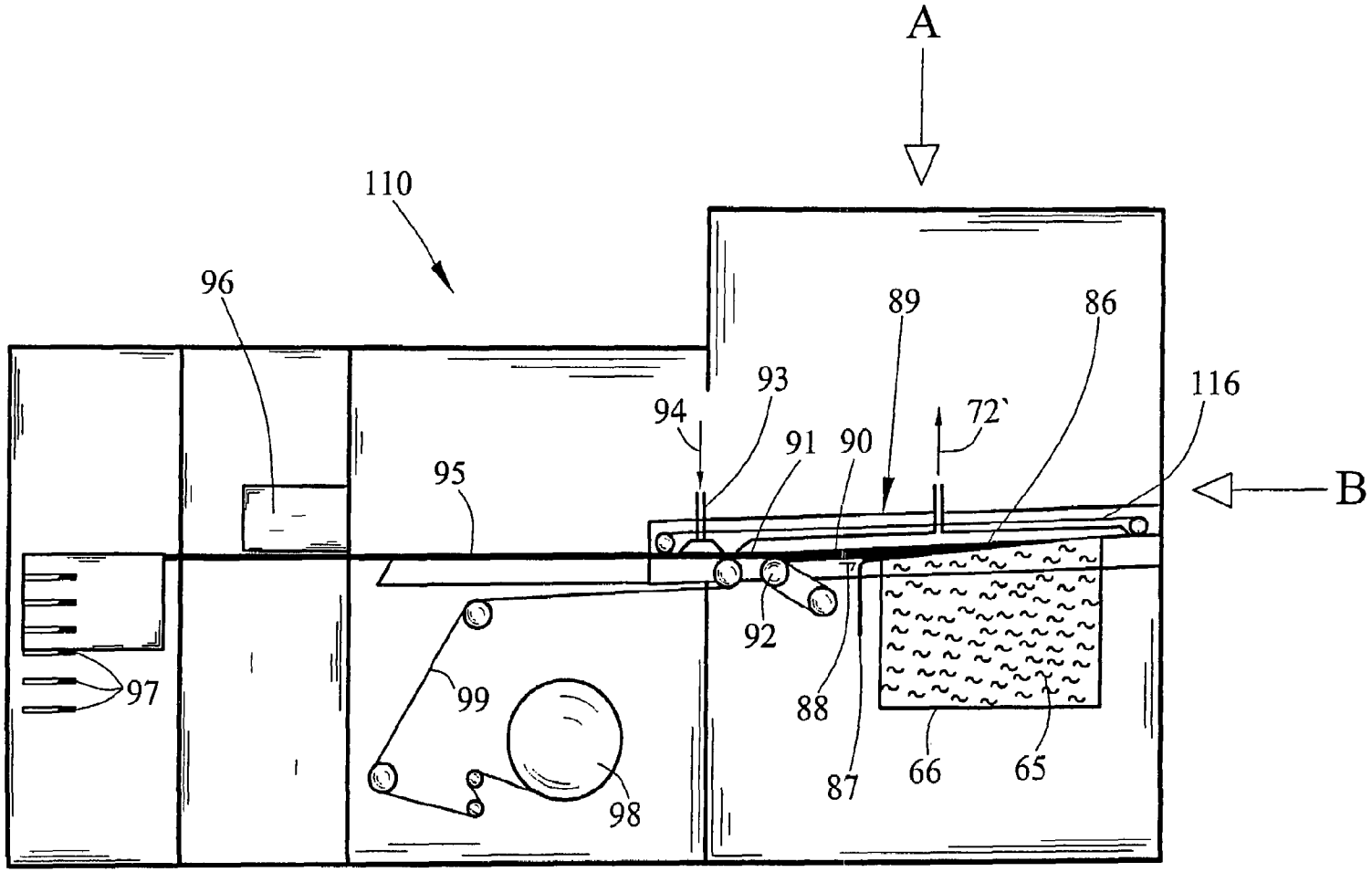
FIG. 10 is a side perspective view of one arrangement of a continuous filter rod making apparatus.
Figure 12:
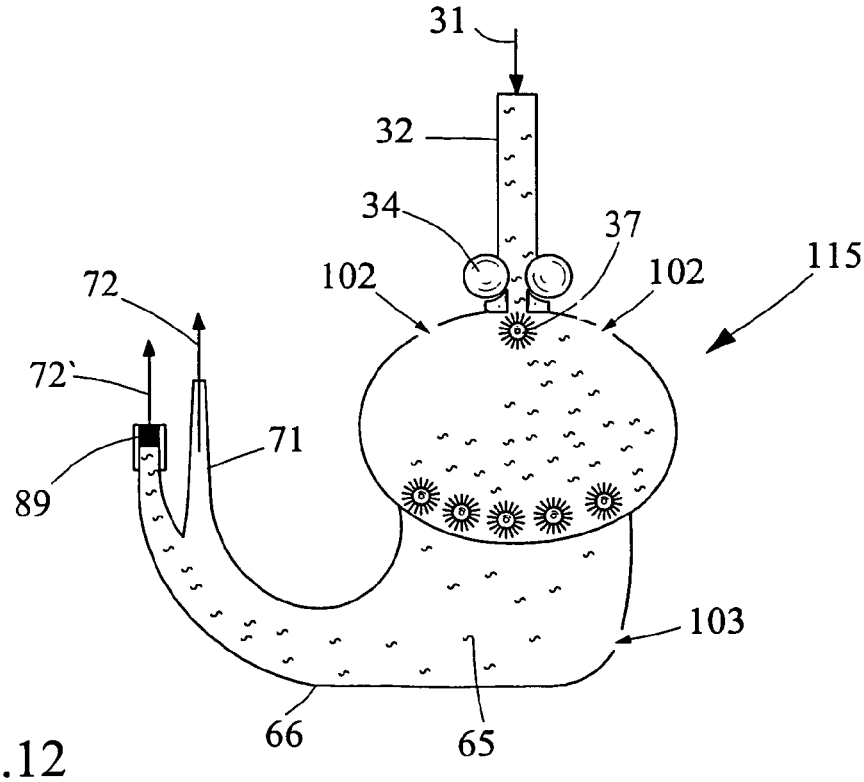
FIG. 12 is a end on schematic perspective view of the continuous filter rod making machine apparatus of FIG. 10 as viewed from the 'B' location.

A suction belt conveyor follows the fluidized bed 66, but is not shown in this FIG. (see also in particular FIGS. 10 and 12). The separated fibers are compiled on the suction belt, wherein two or more suction belts can also be used.

Figure 7:
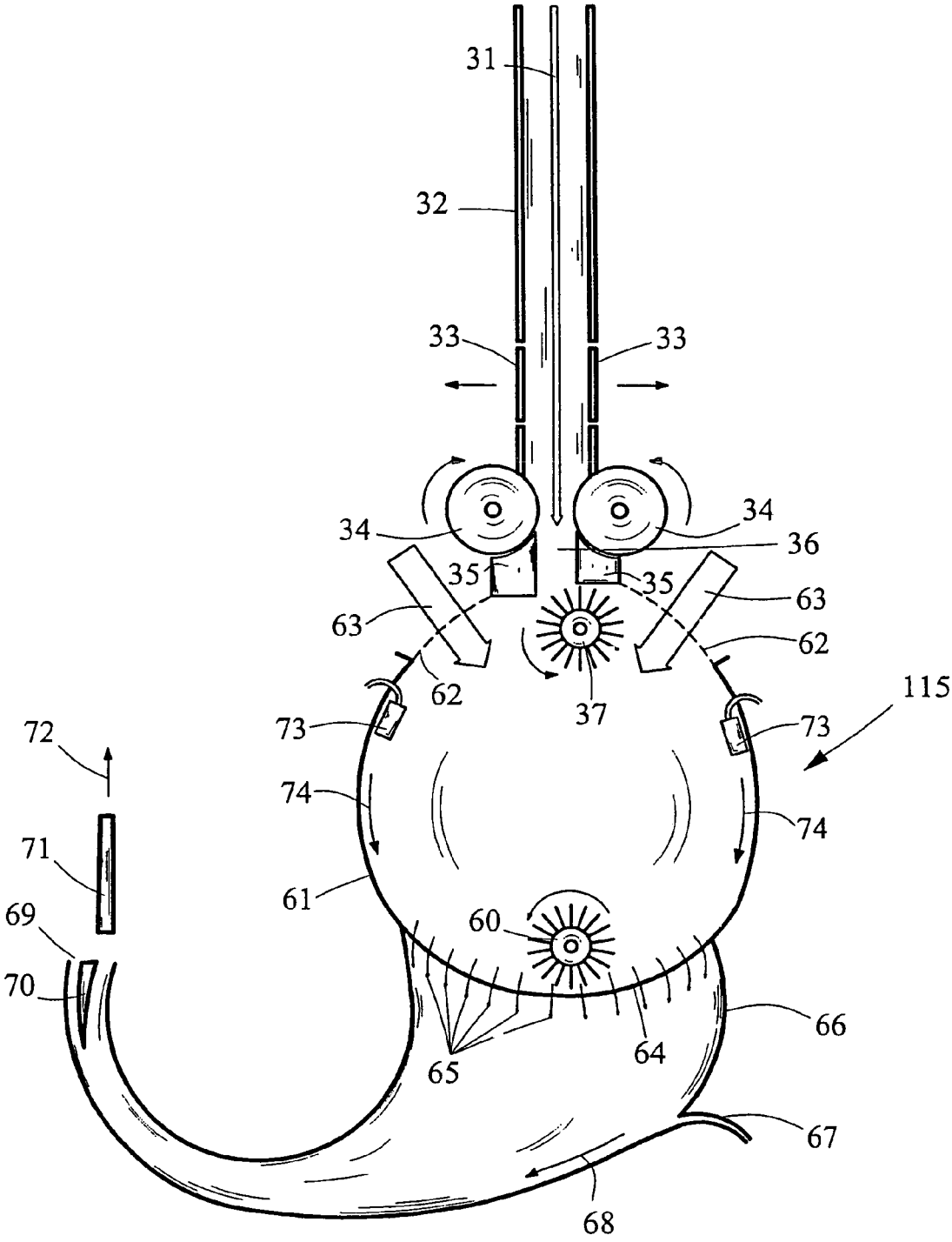
FIG. 7 is a schematic cross-sectional side view representation of one arrangement of a primary metering device containing another embodiment of a filter material separating device.

FIG. 7 shows a different embodiment of a separating device according to the invention. In contrast to the embodiment according to FIG. 6, only one roller 60 is provided for this exemplary embodiment. In addition, several air flows 74 are provided inside the separating chamber 61, which are generated with air nozzles 73. Several air nozzles 73 can also be used, as shown in FIG. 7. These not only can be arranged on the outside surface of the chamber, but can also be distributed in the separation chamber 61. The air flows guide the fibers to the roller 60, wherein several rollers can also be used in place of the one roller. The function of roller 60 and/or the several rollers 60 corresponds to the function described in FIG. 6. The air flows 74 cause an increased swirling inside the separation chamber 61, thus improving the separation of the fibers as compared to the embodiment shown in FIG. 6. The separated fibers 65 correspondingly travel through the screen 64 as shown in FIG. 6.

Figure 8:
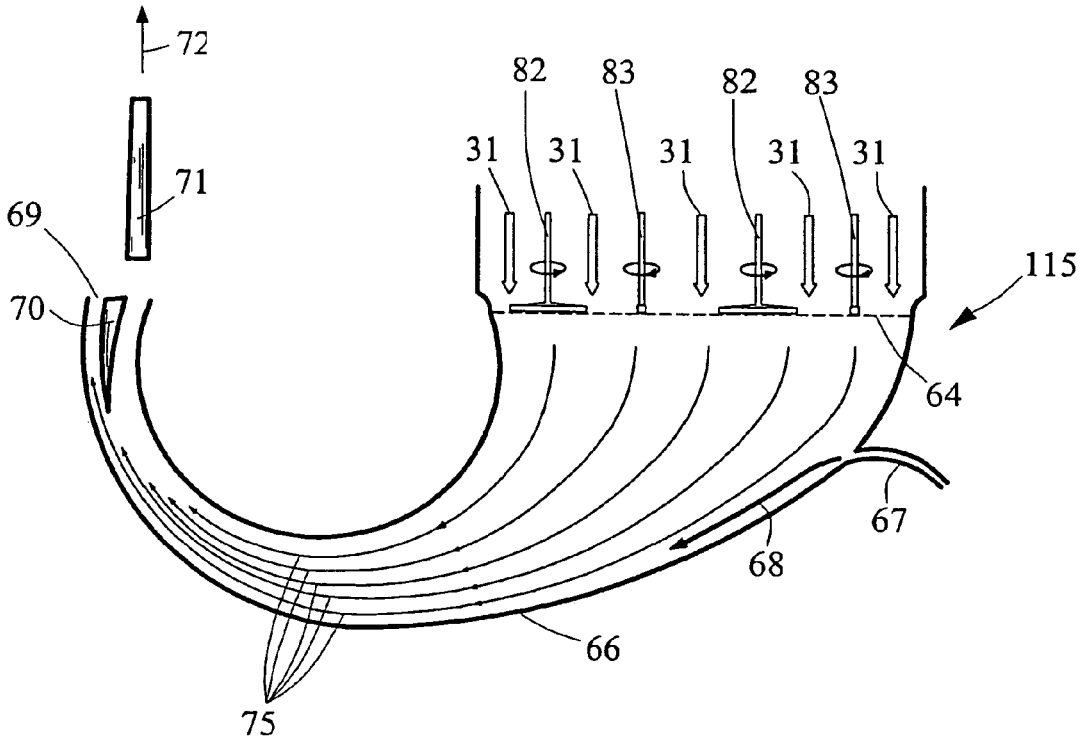
FIG. 8 is a schematic cross-sectional side view representation of one arrangement of a primary metering device containing another embodiment of a filter material separating device.

FIG. 8 shows a different embodiment of a separating device 115 according to the invention. The air flow in this case is generated by the low pressure at the end of the fluidized bed 69 and the air flow 68 flowing from the nozzle lip 67, wherein several nozzle lips can also be used. The main air flow starts above the screen 64 and passes by the rows of stirring mechanisms 82 and 83, as well as the screen 64. Following this, the main air flow travels to the fluidized bed region 66 and passes through the fluidized bed 66 to its end 69.

The essentially non-separated fiber material and/or the fiber/fiber group mixture 31 enters the partially shown housing above the screen 64. Instead of the position shown in FIG. 8, this housing can also be inclined at an angle, e.g. at 45° to the horizontal line. As a result of gravity as well as the main air flow, not shown, the fiber/fiber group mixture 31 travels to the region of stirring mechanisms 82 and 83. Stirring mechanisms 82 and 83 are arranged in rows (not shown) and that consist of successively arranged stirring rods that drive a suitable stirring mechanism. The stirring mechanisms are displaced at an angle of 90° relative to each other, wherein other displacement angles can be provided as well. The non-separated fiber groups are torn apart by the rotating stirring mechanisms, are then accelerated and tossed against the screen 64 of the housing. A perforated sheet or a round bar grid can also be used in place of the screen 64. The fiber groups and/or the fiber group mixtures 31 are tossed against the screen 64 until they have been separated into individual fibers and with the main air flow have passed through the screen 64. Subsequently, fibers 75 travel along the fluidized bed 66, as for the previous exemplary embodiments, and to a suction belt conveyor that is also not shown in FIG. 8. The separating device shown in FIG. 8 is known, at least with respect to the rows of stirring mechanisms 82 and 83, from European Patent Document EP 0 616 056 B1 owned by M+J Fibretech A/S, Denmark, the contents of which are incorporated fully into the present patent application.

Figure 9:
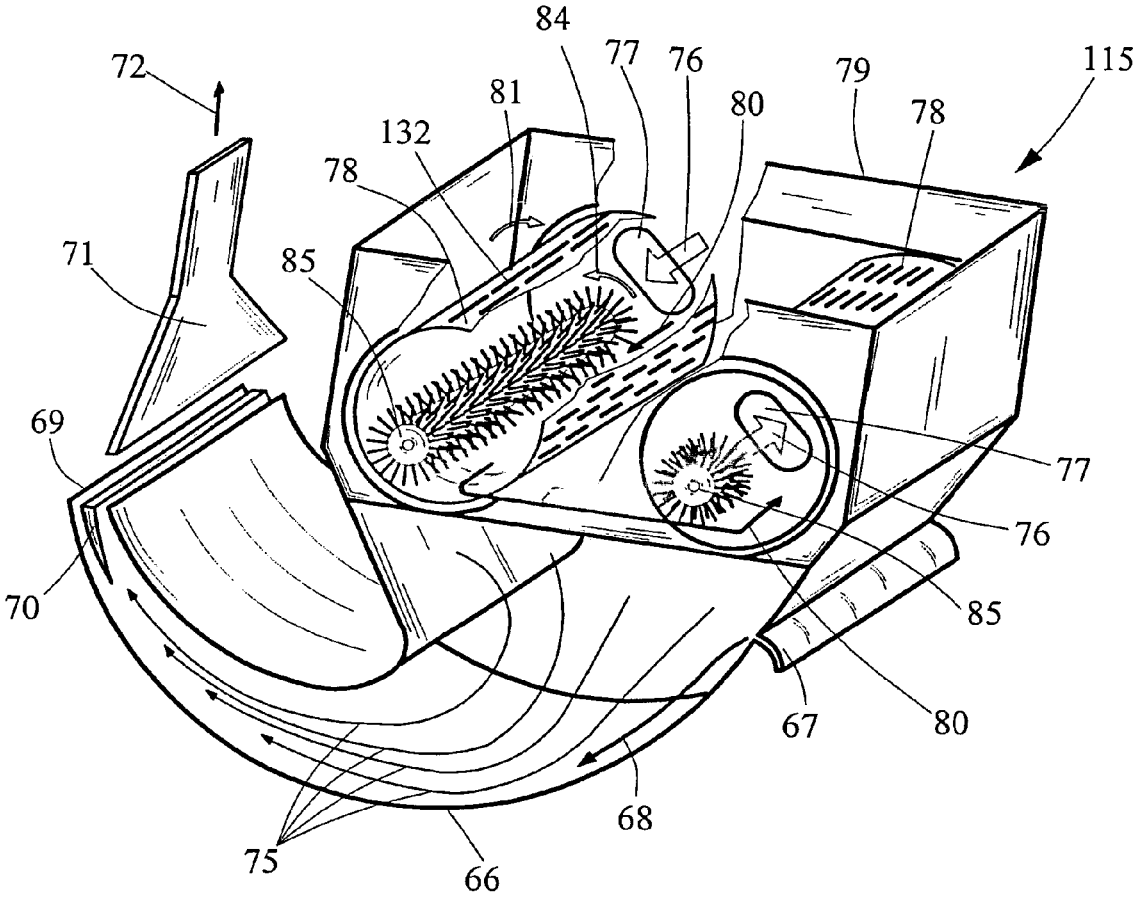
FIG. 9 is a three-dimensional schematic representation of another embodiment of a filter material separating device.

A different exemplary embodiment of the separating device 115 according to the invention is shown in a schematic, three-dimensional representation in FIG. 9. The essentially non-separated fiber material and/or fiber/fiber group mixture, not shown, is transported by air flows 76 to screening drums 78, via openings 77 on the side of housing 79. The fiber material is blown in the direction of the longitudinal axes into the screening drums 78. A circular flow 80 is generated by blowing the fiber material from both sides in counter-clockwise direction into the drum. This circular flow 80 is superimposed by a normal flow, not shown, and/or a flow that is essentially perpendicular thereto and is caused by a low pressure at the fluidized bed end 69 and an air flow 68. The low pressure at the fluidized bed end 69 is generated by a low pressure in a suction belt conveyor, not shown herein, which is arranged at the fluidized bed end 69, as well as by an air flow 72 flowing through the exhaust pipe 71. The normal flow starts above the screening drums 78 and passes through the screening drums 78 via the drum sleeve openings. The normal flow then travels to the fluidized bed region 66 and passes through this region to the end 69 where a portion of the normal flow is separated from the fibers at the wedge 70.

The non-separated fiber material inside the drums 78 is deposited on the inside sleeve surfaces of drums 78. The drums 78 rotate in a clockwise direction 81 as viewed in FIG. 9. The essentially non-separated fiber material deposited on the drum sleeve surfaces is then fed by the rotating drums to separating rollers 85. The separating rollers 85 rotate counter-clockwise in the direction 84 as viewed in FIG. 9. Alternatively, they could also rotate in the clockwise direction. The separating rollers 85 and/or the needle rollers pick up the non-separated fiber groups and tear these apart as well as accelerate them. The fiber groups are tossed against the inside drum sleeve surface of drums 78 until they have separated into individual fibers and have passed through the drum sleeve openings, meaning until they have been picked up by the air flow (the normal flow) and are guided and/or sucked through the screening drum 78. A drum with perforated sheets or round bar grids can also be used in place of the screening drum 78.

The fibers and/or separated fibers are picked up by an air flow and guided and/or sucked through the radial openings in the drum. The air flow 76 conveys the fibers in downward direction to the fluidized bed. As soon as the fiber-loaded flow arrives at the fluidized bed, it is deflected and guided along the curved fluidized bed. As a result of the gravitational forces acting upon the fibers, the fibers move toward the curved guide wall and flow to the suction belt conveyor. The air flowing along above the fibers is separated at the wedge and/or separator 70 and discharged via the exhaust pipe 71.

The respective fiber flows 75 are shown schematically in FIG. 9. Separated fibers are picked up by an air flow 68 that exits at the nozzle lip 67 and are also supplied to the fluidized bed end with the air flow 68, in the same way as the separated fibers that are fed to the fluidized bed 66. Several nozzle lips can also be provided.

Fiber groups that are not separated or not completely separated during a single passage through the drums 78 are supplied via the circular flow 80 to the respectively parallel drum 78. For the separation, the fibers will flow through the openings 132 of the screening drums 78, wherein essentially only separated fibers can pass through the openings 132. The openings 132 are thus designed such that only separated fibers can pass through.

The separating device shown in FIG. 9 corresponds at least in part to the one disclosed in International Patent Publication WO 01/54873 A1 and U.S. Pat. No. 4,640,810 A. assigned to Scanweb of Denmark and/or the United States. The content disclosed in the above-referenced patent documents are incorporated fully into the disclosure of the present patent application.

Figure 11:
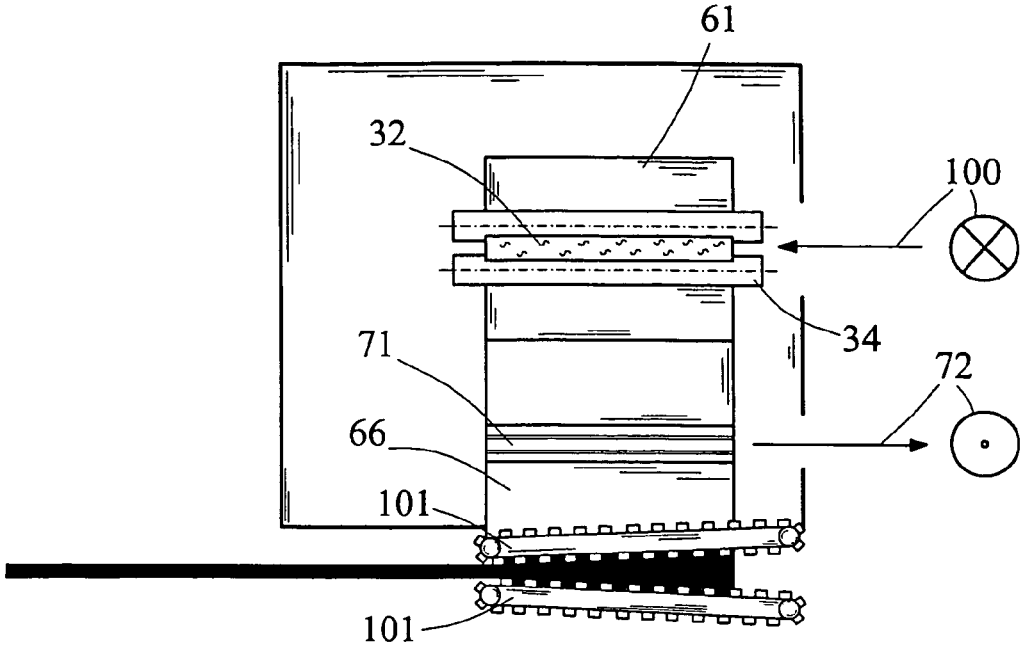
FIG. 11 is a top down perspective view of the continuous filter rod making machine apparatus of FIG. 10 as viewed from the 'A' location.

FIG. 10 shows a schematic representation of a continuous rod machine 110. FIG. 11 shows a portion of a continuous rod machine 110, in a view from above and along the arrow A. FIG. 12 shows a view from the side of the continuous rod machine 110 according to FIG. 10 in the direction of arrow B.

With reference to FIGS. 10-12, a non-separated fiber material travels via the accumulation chute 32 to the metering device 34, which in this example is represented by a pair of feed rollers 34 with a rotating roller 37. In FIG. 11, the direction of the material feed-in 100 is downward in the drawing plane, as shown schematically therein. The non-separated fiber material is separated in the separating chamber 61. The air flow at the fluidized bed 66, which is generated by the air flow in the exhaust pipe 71 and the air flow 72' at the suction belt conveyor 89, conveys the separated fibers 65 (FIG. 12). According to FIG. 11, the direction of the air flow 72 in the exhaust pipe 71 is upward and out of the drawing plane. The air flow 72 also removes excess fibers. The air flow 72' functions to hold in place the fibers 65 that are compiled on the suction belt 89 (FIGS. 10 and 12).

The separated fibers 65 move on the fluidized bed 66 in the direction toward the fluidized bed end 69 where a suction belt conveyor 89 is arranged, as shown in the FIGS. 10-12. As a result of the continuous suctioning out of air, a low pressure is present at the suction belt conveyor 89. The suctioning out of air is shown schematically with the air flow 72'. The low pressure pulls the separated fibers 65 against the air-permeable suction belt of suction belt conveyor 89 and keeps them there.

The separated fibers 65 are correspondingly compiled on the air-permeable suction belt of the suction belt conveyor 89. The suction belt 116 moves in the direction of the continuous rod machine 110, meaning to the left in FIG. 10. A fiber cake and/or fiber flow 86, FIG. 10, forms on the suction belt, which increases nearly linearly in size in the direction toward the continuous rod machine 110. The compiled fiber flow 86 varies in thickness and is trimmed with a trimming device 88 to reach a uniform size. The trimming device 88 can be a mechanical device, e.g. trimming disks or plates, or a pneumatic device such as air nozzles. The mechanical trimming is known per se from continuous cigarette rod machines. For the pneumatic trimming, a nozzle that discharges an air flow is arranged horizontally at the end of the fiber flow 86 and tears out a portion of the fiber flow 86, so that excess fibers 87 are removed, wherein a pointed nozzle or a flat nozzle can be used as well.

Following the trimming operation, the fiber flow 86 is divided into a trimmed continuous fiber rod 90 and a rod of excess fibers 87. A nozzle jet, not shown, can also be used to pick up and tear off all fibers below a trimming dimension. The excess fibers are returned to the fiber preparation process and are later on used to form another continuous fiber rod.

The trimmed fiber rod 90 is held against the suction belt 116 and is moved in the direction of the continuous rod machine 110. The trimmed fiber rod 90 is a loose nonwoven fiber composite which is compacted with the aid of a compacting belt 92. However, a roller can also be used in place of the compacting belt 92, or several belts and/or rollers can be used. As shown in FIG. 11, the fiber cake is furthermore also compacted on the side, wherein FIG. 11 shows the compacting belts 101 moving toward each other at a conical angle while operated at the speed of the suction belt with the fiber cake. The serrated or toothed shape of the compacting belts 101 creates zones of varying density in the compacted fiber cake. The filter rod 91 is later on cut in the zones with higher density. The higher fiber density in the filter end region ensures a more compact consistency of the fibers in this sensitive zone and, additionally, makes it easier to process the filter rods. A compacting belt 92 is provided for the compacting in the vertical direction, wherein rollers can also be provided in place of the compacting belt 92.

The trimmed and compacted fiber rod 91 is transferred to the continuous rod machine 110. For the transfer, the compacted fiber rod 91 is lifted off the suction belt 116 and the rod 91 is then deposited on a format belt of the continuous rod machine 110, wherein the format belt is not shown in the FIGS. The format belt can be a standard format belt, such as the ones used for a standard continuous filter rod machine and/or continuous cigarette rod machine. The transfer is aided by a nozzle 93, which directs an air flow 94 from the top onto the compacted fiber rod 91.

A continuous fiber filter rod 95 is formed in the continuous rod machine 110, wherein a bobbin 98 wraps a wrapping material web 99 in the standard way around the fiber material. A certain internal pressure builds up in the fiber filter rod 95 as a result of volume reduction and the shaping of the compacted fiber rod 91 into a circular and/or oval form during the wrapping with the wrapping material web 99. In a curing device 96, bonding components contained in the fiber mixture are heated on the surface and slightly melted. The outer layers of bi-component fibers can correspondingly be melted, so that a bond is created between the fibers. For this, we point in particular to German Patent Application DE 102 17 410.5, commonly owned by the assignee of the present application. The curing device 96 can also be a microwave heater, a laser heater, heating plates and/or sliding contacts. As a result of heating up the bonding components, the individual fibers in the fiber rod will bond and melt together on the surface. During the cooling of the fiber rod, the melted regions harden once more and the resulting grid structure imparts stability and hardness to the continuous fiber rod. Following this, the cured fiber filter rod 95 is cut into individual rod sections 97. The curing of the fiber filter can also take place following the cutting into fiber filter rod sections 97.

The air flow 102 shown in FIG. 12 also functions to transport the fiber materials, in the same way as the air flows in previous examples.

Figure 13:
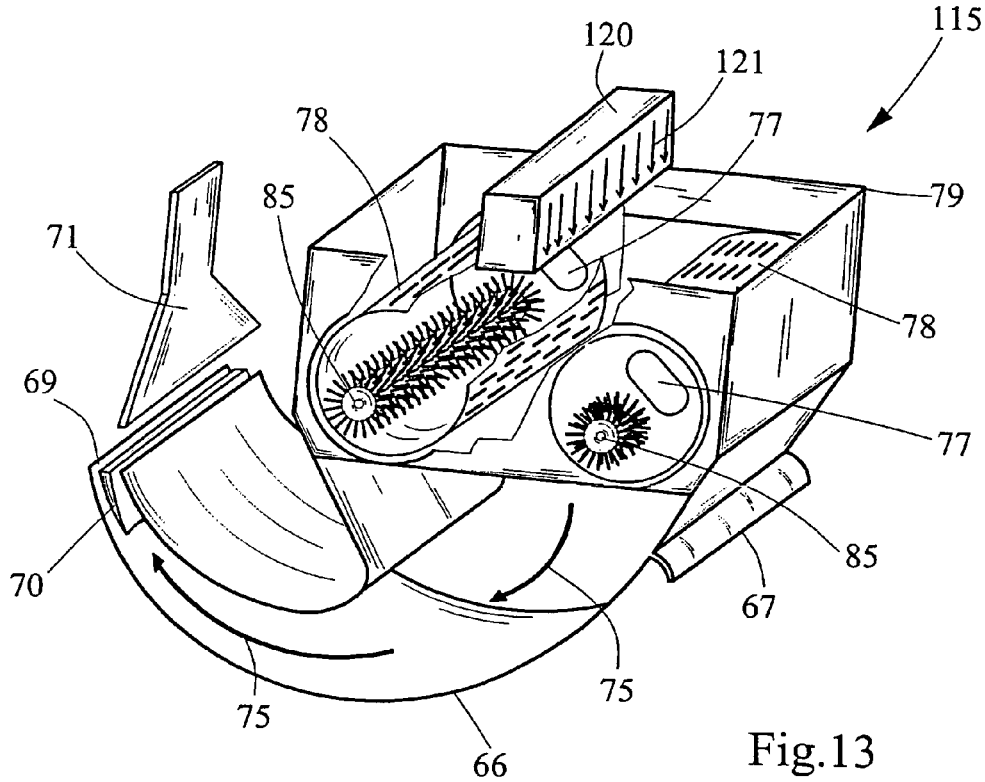
FIG. 13 is a schematic three-dimensional view of yet another embodiment of a filter material separating device.

FIG. 13 shows a three-dimensional representation of a fifth embodiment of the separating device according to the invention, which is similar to the one shown in FIG. 9. A granulate metering device 120 is provided in addition to the embodiment shown in FIG. 9. The granulate metering device 120 pours granulate across the complete width of the separating device 115 into the separating device 115 between the screening drums 78. In the region of screening drums 78, the poured-in granulate 121 mixes with the fibers leaving the screening drums 78. A flowing mixture of separated fibers and granulate 75 is thus created, which is conveyed by the air flow on the fluidized bed to the suction belt conveyor, arranged in the conveying direction behind the suction belt end 69.

Figure 14:
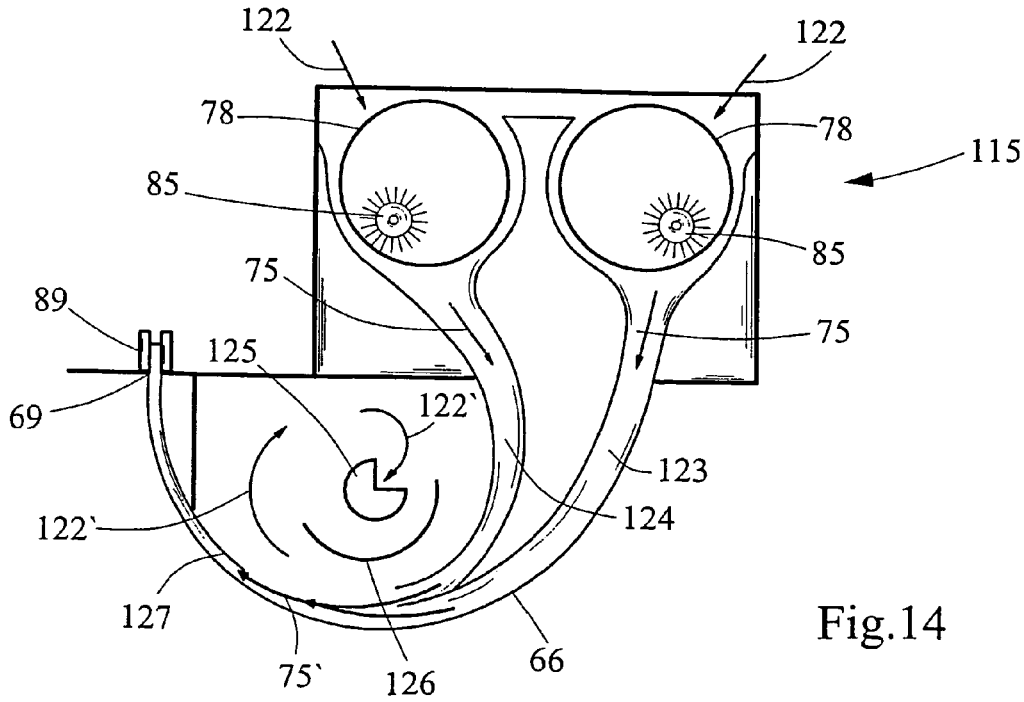
FIG. 14 is a schematic cross-sectional side view of a different embodiment of a filter material separating device separating device.

FIG. 14 shows a schematic cross sectional representation of a different separating device 115 according to the invention. The air flow is improved in this embodiment, so that more uniform air flows 75 and 75' are created. An air flow 122 enters the arrangement in the upper region of the screening drum 78. The separated fibers leaving the screening drums 78 travel to the channels 123 and 124 and are moved downward with the respective air flow to the region of fluidized bed 66. The fiber flows 75 are combined to form a fiber flow 75' in the lower region of the fluidized bed. In this region, a large portion of the transport air is separated from the fiber flow, which is shown with the air flow 122'. For this, an exhaust pipe 125 is provided in the rolling area 126 of the fluidized bed 66. Once the two fiber flows 75 are combined, the fiber flow 75' flows into a channel formed by the fluidized bed 66 and the separator 127. At this location, a nonwoven fiber composite may already have formed, depending on the process sequence, or the fibers may still be separated. The fiber flow 75' is subsequently transported with the aid of the low pressure at the suction belt conveyor 89 to the fluidized bed end 69 and the suction belt conveyor 89.

Figure 15:
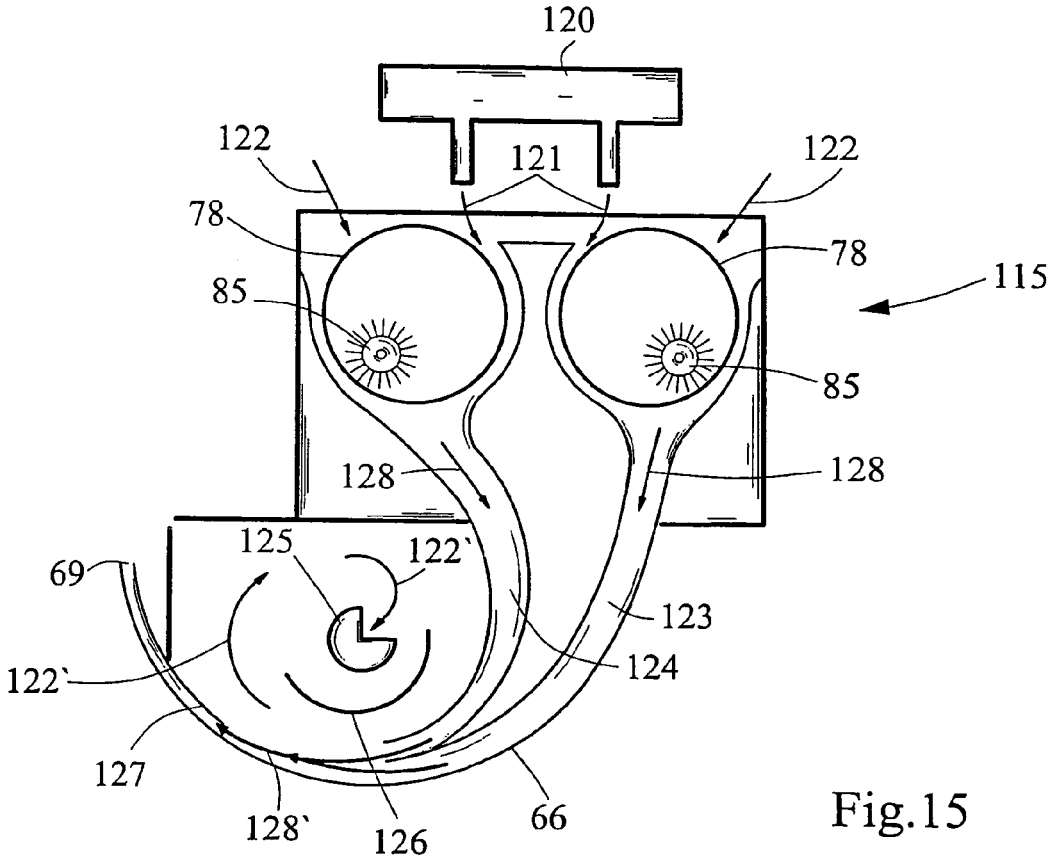
FIG. 15 is a schematic representation of the separating device of FIG. 14, additionally showing a granulate feed station.

The schematic sectional representation in FIG. 15 is similar to the one shown in FIG. 14. However, a granulate metering device 120 is arranged above the screening drums 78 in a modification as compared to the embodiment shown in FIG. 14. Granulate 121 is supplied with two pipes to the respective screening drums 78. The resulting fiber/granulate flows 128, which are transported in the channels 123 and 124, are combined in the lower region of fluidized bed 66 to form a fiber/granulate flow 128'.

Figure 16:
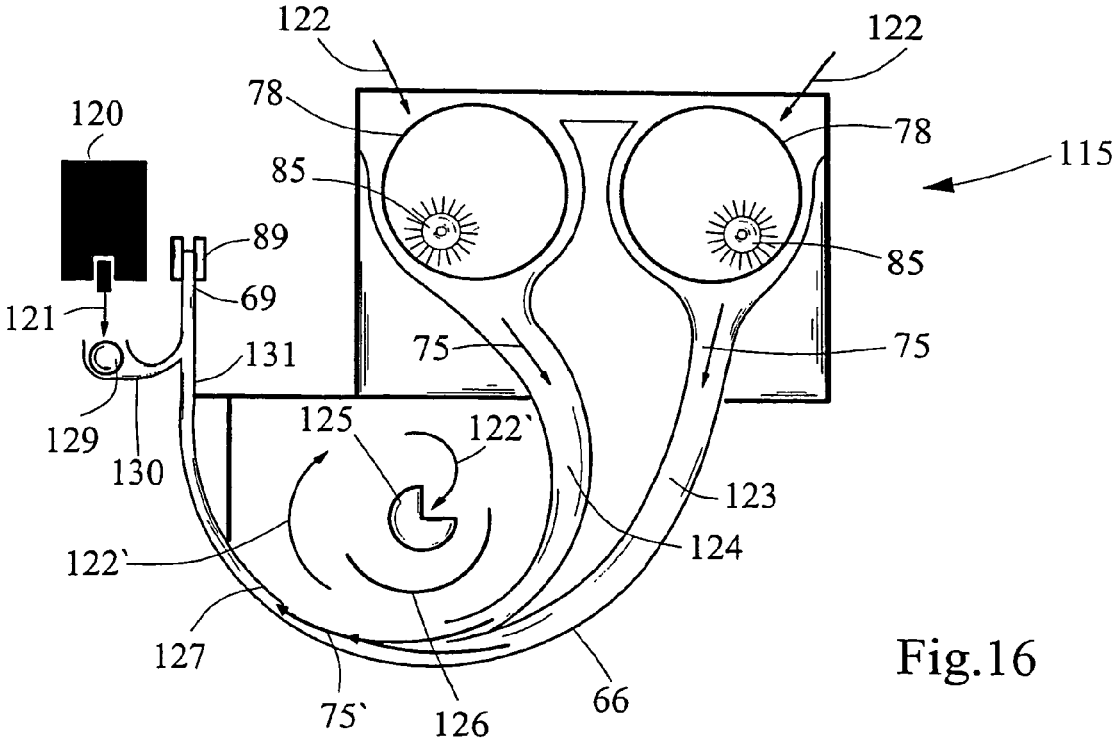
FIG. 16 is a schematic representation of the separating device of FIG. 15, showing the granulate feed station at an alternate location.

FIG. 16 represents a different embodiment according to the invention of a separating device 115. In this case, the granulate 121 from the granulate metering device 120 is supplied near the fluidized bed end 69. The granulate 121 reaches an acceleration element 129, which can be a roller, a brush or a nozzle. The accelerated granulate 121 travels through the line 130 to the fluidized bed, meaning to a vertical fluidized bed section 131.

Figure 17:
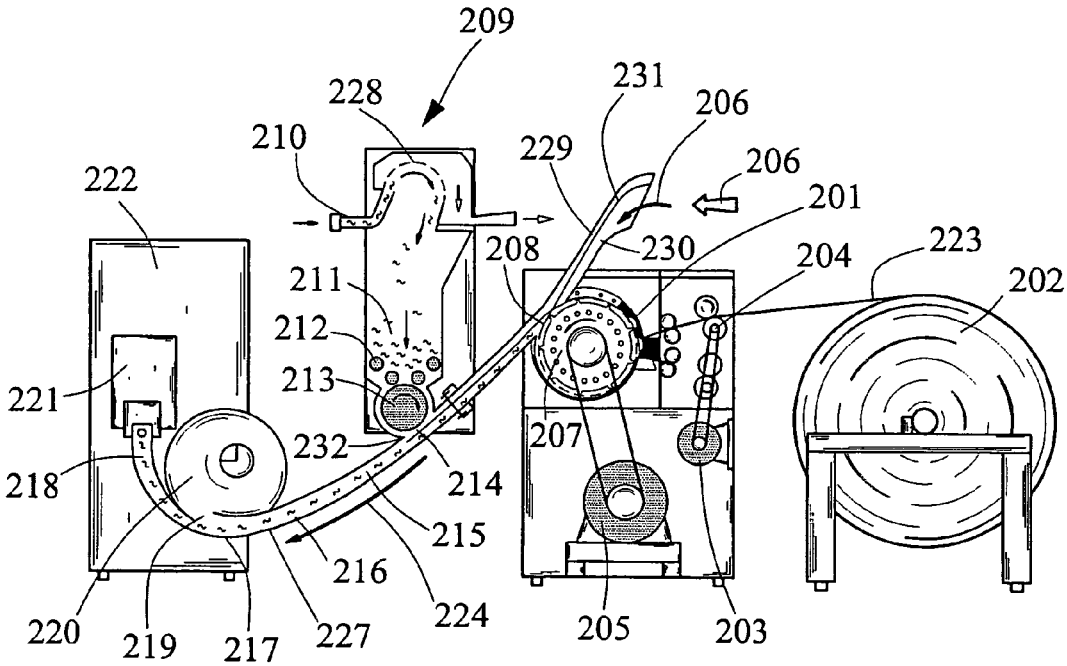
FIG. 17 is a schematic side view of an arrangement of a continuous rod machine for making a continuous of filter material.

FIG. 17 schematically shows an arrangement of continuous filter rod making machine according to one embodiment of the invention in a view from the side. The method to be realized with this machine is used for the manufacture of cigarette filters of suitable fibrous materials of biological and/or synthetic origin, as well as other materials such as granulates. The fiber materials can be the same ones described above. In particular, we reference European application EP 03 004 594.2 entitled "ZIGARETTENFILTER UND VERFAHREN ZUR HERSTELLUNG DESSELBEN" [Cigarette Filter and Method for Producing Same], commonly owned by the assignee of the present application. Filters can be produced from the fibers of a single type of material as well as from an optional mixture of fibers composed of different materials or compositions. Filters produced from the fibers of a single type of material require only one filter-material feeding device 201 and/or 209 for the continuous filter rod machine as shown in FIG. 17, however more than one feeding device may be employed if desired. The produced filters, which can also be called fiber filters, are in part biodegradable, depending on the fiber mixture. The goal is to have a round or oval filter rod shape and/or the filter rod form at the end of the production process.

The device shown in FIG. 17 processes two different types of fibers, which are fed at two metering locations to the fluidized bed 216 from two filter material feeding devices, namely a metered opener 209 and a fiber crusher 201. The first metering location is at the transition between fiber crusher 201 and a fiber channel 215, not shown, after which directly follows downstream the fluidized bed 216. The base material is a raw cellulose material such as cellulose acetate fibers in the form of a nonwoven fiber composite 223, wound around a bobbin 202. The nonwoven fiber composite 223 is fed via a feed roller pair 204, driven by a motor 203, to the fiber crusher 201. A rotating cutting drum 207, driven by a motor 205, disrupts or ruptures the cellulose sheets or nonwoven cellulose composite 223 at high speed. The cutting drum 207 is provided with a plurality of cutting disks. The plurality of cutting disks on cutting drum 207 can be seen more clearly in FIG. 18, which provides a schematic view from above the arrangement of equipment shown in FIG. 17. The cellulose fibers are fed via separator sheets 208 to a strong transport air flow 206.

Figure 19:
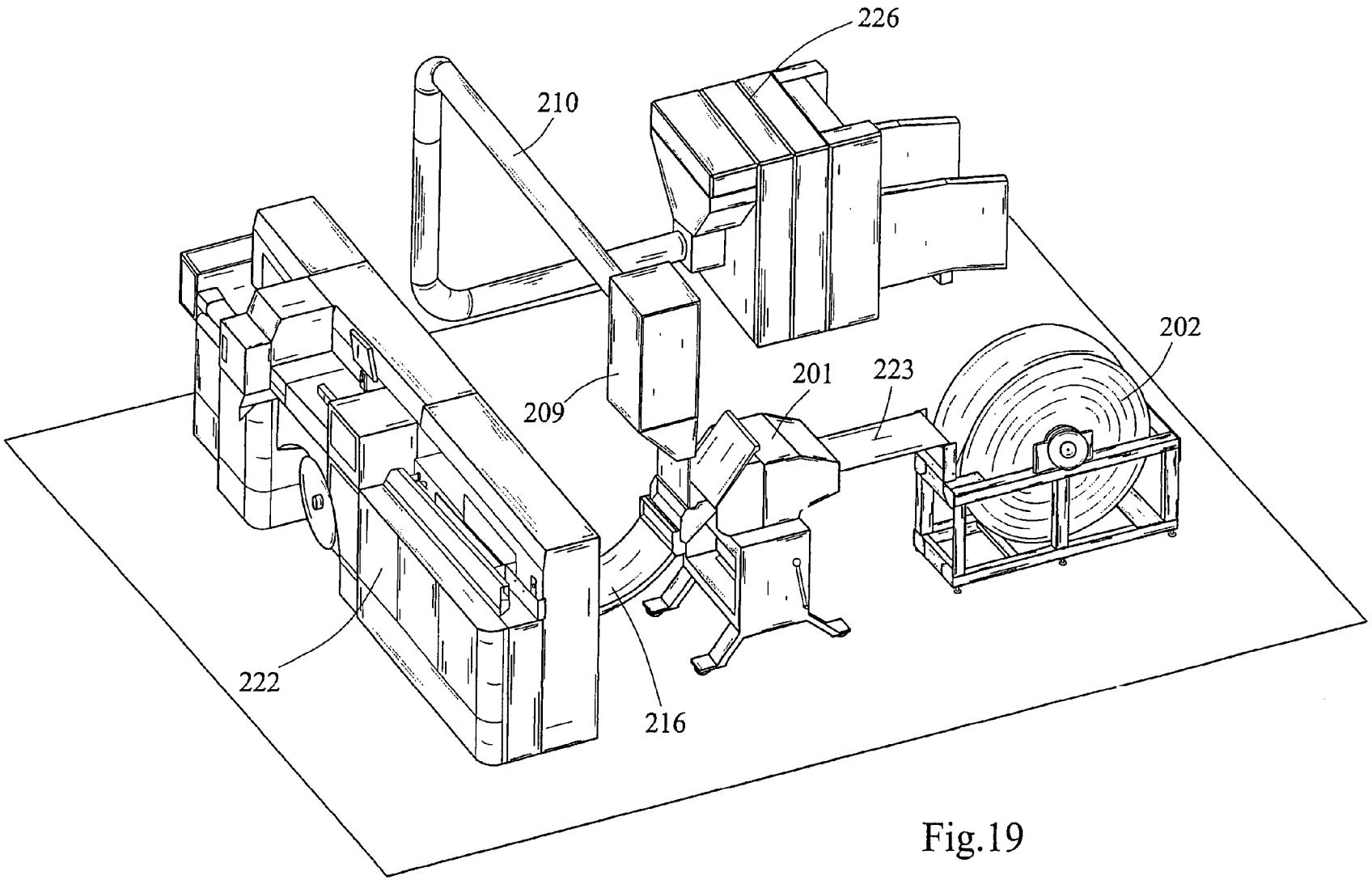
FIG. 19 is a schematic three-dimensional representation of another exemplary embodiment of a continuous rod machine arrangement.

The second metering location is placed at location 214 in the region of the fiber channel 215 where the output for the metered opener 209 is located. FIG. 19 shows that a bale opener 226 is installed in front of the metered opener 209. A respective bale opener can be purchased, for example, from the company Trützscher GmbH, Germany. The fiber material in the form of bales or stacks is separated or essentially separated in the bale opener 226. The fiber material can comprise, for example, bi-component fibers. The separated and/or pre-separated fibers are fed via transport air and a pipeline 210 to the metered opener 209. In the metered opener 209, the fibers are separated by the screen 228 from the transport air and fall into reservoir chute 211.

The reservoir and/or the reservoir chute 211 into which the fibers are discharge and/or drop serves to balance out fluctuating conveying amounts of the bale openers that may result when a bale is changed. The reservoir 211 is thus preferred to make possible a continuous metering of fibers in a production process. Rotating needle transport rollers 212 move the fibers to the needle metering roller 213, wherein the mass throughput can be adjusted by varying the speed of the rotating elements. At one separation point 214, the fibers are combed out of the needles by the transport air flow 206 and are completely separated. This can also be supported by respective separator sheets, which are not shown herein. The fibers are subsequently conveyed in fiber channel 215 and moved to a fluidized bed 216.

The mass throughput of the fiber crusher 201 is controlled by controlling the advance of the material in the form of the nonwoven cellulose 223 to the fiber crusher 201.

Additional metering locations for supplying additional fibers and/or solid materials such as powders or granulates to the fluidized bed can also be provided, but are not shown in this representation.

The transport air flow 206 flows through the two feed channels 229 and 230, shown in FIG. 17, so that initially different filter materials are conveyed in each feed channel. The feed channels are separated by a dividing wall 231. The two feed channels 229 and 230 are combined at location 232 to form fiber channel 215, which is preferably rectangular in shape. Starting at this point, the fiber channel is called a fluidized bed 216. The at least two fiber materials combine in the fluidized bed 216 to form a homogeneous fiber mixture.

The fluidized bed 216 describes a uniform curve function that is tangentially adapted to the fiber channel 215. Above the lowest or bottom location 217 up to the vertical intake wall of the suction belt channel 218, the curve describes a quarter of an ellipse. The sharpest curvature is at the end of the fluidized bed 216 where the fluidized bed turns into the suction belt channel 218. As a result of the curve radius becoming increasingly more narrow in connection with the fiber speed, the fibers are increasingly deposited on the lower sheet metal wall or fluidized bed wall 227 owing to centrifugal force. In the region of the sharpest curvature 219 the fibers encounter the highest centrifugal force. Directly adjacent to this location 219, the fluidized bed 216 again separates into two channels. The lower, fiber-carrying channel empties into the suction channel 218.

The upper channel, which in the ideal case does not contain fibers, is used for discharging the large transport air flow from the system. Fibers that have not been discharged can be separated in a separator, not shown, and can be reused. The transport air flow 206 in part is generated by a ventilator connected to the suction belt conveyor 221, which creates a low pressure in the suction belt conveyor and the fluidized bed. The necessary air flow 206 for operating the fiber crusher 201 and/or the metered opener 209 is not generated solely by the suction belt ventilator. Additionally required transport air flow 206 can be generated by a second ventilator connected to the fluidized bed separator 220, if desired.

The ratio of suctioned-off air volume at the separation location 219 is influenced by the desired air speeds and the cross-sectional capacity. The air volume flowing in both lines can also be adjusted by regulating the ventilators following the separation.

Figure 18:
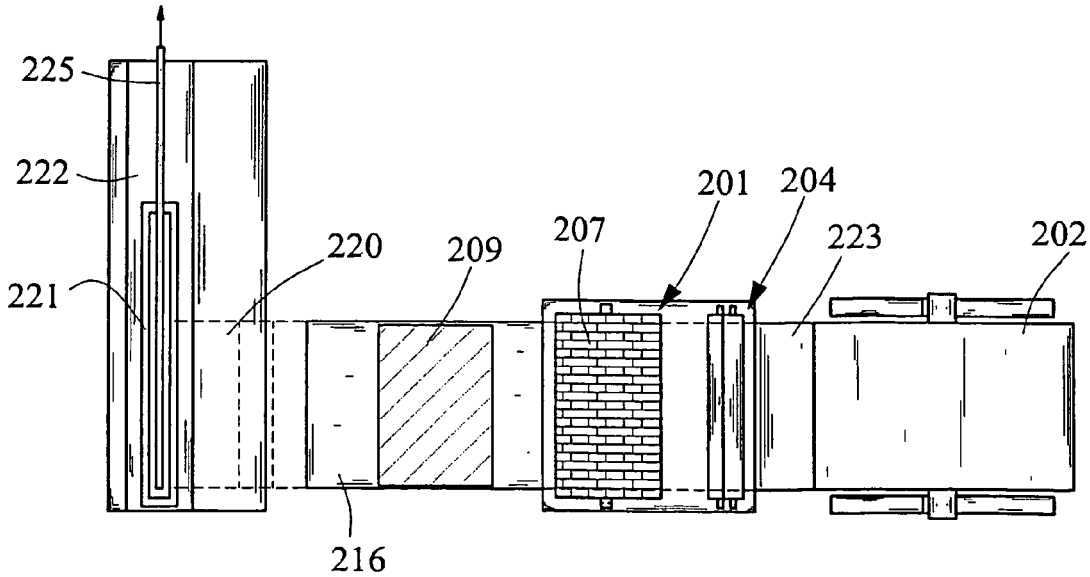
FIG. 18 is a schematic top down view of the continuous rod machine arrangement of FIG. 17.

A fiber cake and/or a nonwoven fiber composite forms on the suction belt conveyor 221, which is continuously conveyed further by the suction belt to a continuous filter rod machine 222, as shown in FIGS. 18 and 19. The filter is subsequently produced in the standard manner, e.g. on the machine called KDF, which is described in European Patent Application 03 007 675.5 and entitled "VERFAHREN UND EINRICHTUNG ZUR HERSTELLUNG EINES FILTERSTRANGS" [Method and Arrangement for Producing a Continuous Filter Rod], and commonly owned by the assignee of the present application. The contents of this German patent application is incorporated in its entirety into the present patent application.

To produce filters from finite fibers comprising at least two different types of fibers, one of which is preferably a bi-component fiber, the different fiber types are supplied via different metering systems to different locations in the feed channel of a fluidized bed or directly to a fluidized bed. The transport air for the fibers can be generated with a ventilator for the suction belt conveyor connected to the fluidized bed or a ventilator at the fluidized bed separator, or both.

FIG. 18 shows a continuous filter rod 225 that is produced by the rod making machine and is conveyed in the direction indicated by the arrow.

FIG. 19 shows one embodiment of an arrangement of machines to be used for a continuous rod machine. The fluidized bed 216 is followed by a continuous filter rod machine 222, which has a similar design as a cigarette machine, but which has been adapted to handle the different characteristics of the filter materials (different types of fiber materials and/or granulate or powder) as compared to tobacco fibers.

Figure 20:
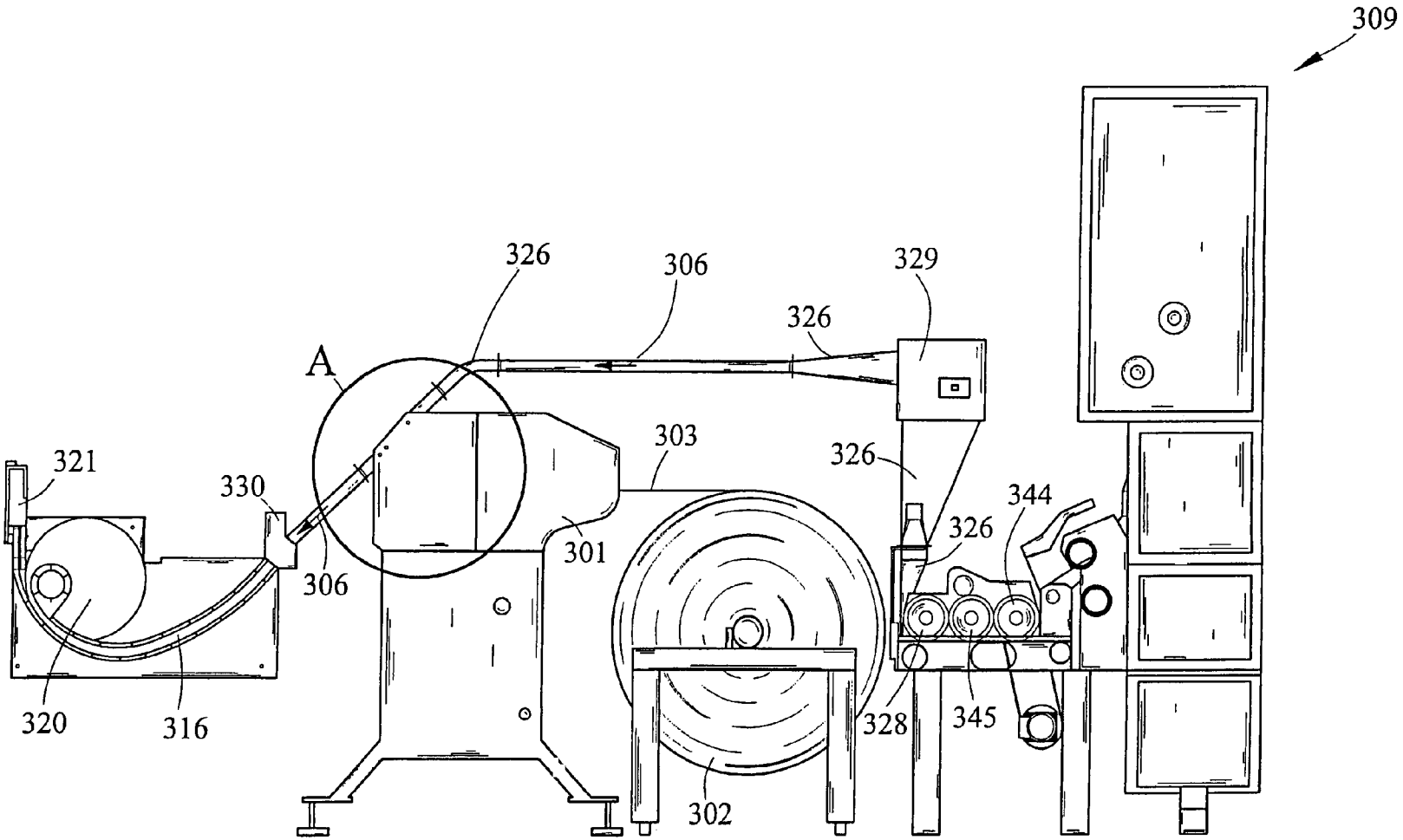
FIG. 20 is a schematic side view representation of another exemplary embodiment of a continuous rod machine arrangement.

FIG. 20 schematically shows yet another embodiment of a continuous rod apparatus. In this configuration, the bonding fibers, e.g. the bi-component fibers, are fed at a first location to the filter production process, whereas filler fibers such as cellulose fibers from a fiber mat or nonwoven fibers 303 are supplied from a bobbin 302 to the bonding fiber flow at a fiber crusher rotor and/or a cutting drum 307 where they are mixed together with the aid of the cutting drum 307.

The mode of operation is as follows: In a metering and processing device 309, bonding fibers are metered and processed. The metering and processing device 309 is arranged upstream of a fiber crusher 301. The metering and processing device 309 releases bonding fibers 323, FIG. 21, from the roller 328 to an air flow 306. The bonding fibers can be multi-component fibers, in particular bi-component fibers. For this, we refer to German patent DE 102 17 410.5, commonly owned by the assignee of the present application.

Figure 21:
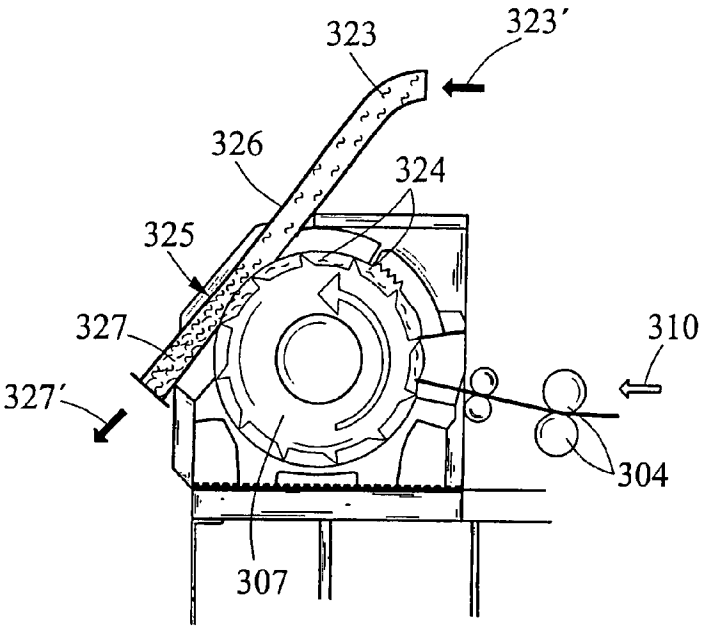
FIG. 21 is a schematic enlarged detail side view of the section 'A' of the arrangement of FIG. 20.

As shown in FIG. 21, the air flow 306 in the channel 326 and also in the fluidized bed channel 316 is generated either completely or essentially by the rotation of cutting drum 307 in the channel region 325 of channel 326. The air flow 306 is furthermore aided and removed from the process by the ventilator and/or suction air blower on the suction belt conveyor 321 and the ventilator and/or circulation fan that suctions air from the fluidized bed separator 320. The blower and/or ventilator 329 optionally supports the air flow 306.

The air flow 306 that is loaded with bonding fibers 323 travels to the channel region 325 of the cutting drum 307. The feed rollers 304 convey a fiber mat and/or a nonwoven fiber composite or structure 303 from the bobbin 302 to the cutting drum 307. The cutting drum 307 separates the nonwoven fiber composite 303 into individual fibers 324. The individual fibers 324 are thrown from the cutting drum 307 into the channel region 325 of the channel 326 where they mixed with the bonding fibers 323. This fiber mixture 327 is transported with the aid of the air flow 306 in the channel 326 to the fluidized bed channel 316. In this exemplary arrangement, it is possible to add a granulate material to the fiber mixture 327 by means of a feed chute 330 that is installed between the channel 326 and the fluidized bed channel 316.

The bonding fibers 323 can also consist of a mixture of different fibers, e.g. a mixture of polypropylene fibers and bi-component fibers. The metering and processing device 309 is suitable for mixing and metering these fibers.

FIG. 21 shows an enlarged schematic detailed view of location A of the arrangement shown in FIG. 20, wherein the housing around the fiber crusher 301 has been removed. The mixing of the bi-component fibers 323 and/or the bonding fibers 323 and the individual fibers 324 with the aid of the cutting drum 307 is shown particularly well. The conveying direction 323' of the bonding fibers 323 and the conveying direction 327' of the fiber mixture 327 is also shown. In addition, the conveying direction 310 of the nonwoven mat 303 is shown.

Figure 22:
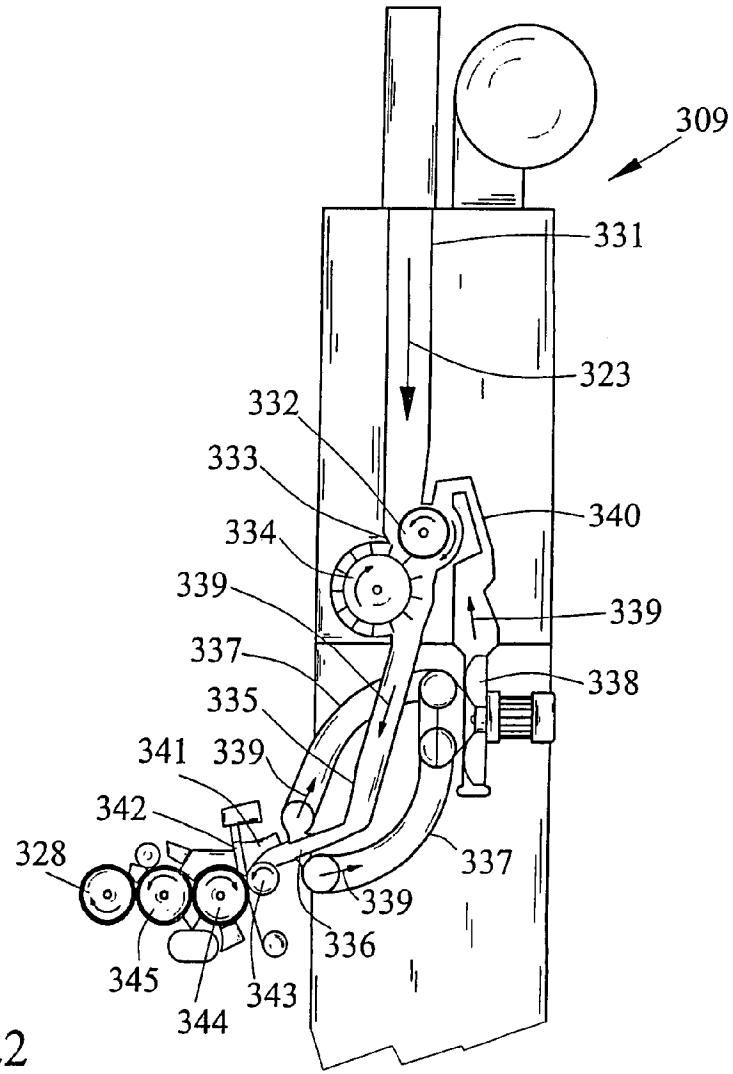
FIG. 22 is a schematic detail side view of an embodiment of a metering and separating arrangement.

The bonding fibers 323 and, alternatively, other optional fiber mixtures such as a mixture of bi-component bonding fibers and filler fibers of polypropylene are filled into the chute 331. Another embodiment of a metering and processing device 309 is shown schematically and in further detail in FIG. 22.

Fibers 323 move downward inside the chute 331. At the lower end of the chute 331, the fibers 323 are gripped by the slowly moving feed roller 332. The feed roller 332 conveys the fibers 323 against an indentation 333 that is positioned resiliently. In the process, the fibers 323 are drawn in and compacted to form a thin fiber cake, not shown herein.

The fiber cake that is conveyed downward between feed roller 332 and indentation 333 is subsequently cut off at the lower end of the indentation 333 by the fast-rotating beater roller 334. In the process, the fibers 323 are loosened up, are separated and are fed with the air flow 339 into the chute 335.

The ventilator 338 generates a circular air flow 339. The air flow 339 is guided inside the channel 340 and subsequently past the feed roller 332. In the process, the air flow 339 cleans the feed roller 332. Subsequently, the air flow 339 picks up fibers 323 and transports these downward inside the chute 335.

Following the redirecting of the chute 335 in the horizontal direction. The chute 335 is designed in the region 336 in such a way that the chute walls on the top and on the bottom have a comb-type shape. That is to say, these walls contains recesses through which the air can flow. The air flow 339 in this region 336 is separated via the combs, which are not shown in FIG. 22, from the fibers 323. The air flow 339 in the comb-type region 336 is suctioned out by the ventilator 338 via the pipes 337, thus closing the air flow 339 cycle.

The fibers separated from the air flow 339 are picked up at the end of chute 335, namely behind the comb-type region 336 by a slowly rotating feed roller 343 and are conveyed in the direction of the indentation 341 and subsequently against a leaf-spring accumulator 342. The indentation 341 is positioned so as to elastically flex. A thin, compact fiber cake is thus created, which is not shown, and is conveyed and compacted between the feed roller 343, the indentation 341 and the leaf-spring accumulator 342.

As the fiber cake leaves the operating region of the leaf-spring accumulator 342, it is gripped and taken over by a fast-moving roller 344. The rollers 344, 345 and 328 are provided with saw-tooth or trapezoidal tooth coverings. The roller speeds increase from roller 344 to roller 328.

The fibers 323 are held in the roller 344 covering during one rotation of approximately 180°. Subsequently, the fibers 323 are transferred tangentially to the roller 345 that rotates in a counter-clockwise direction. Since roller 345 rotates faster than roller 344 and, in particular, is provided with a finer saw-tooth or trapezoidal tooth covering, the fibers are oriented longitudinally parallel to each other during the transfer.

After the fibers 323 have been held in the covering of roller 345 for an approximately 180° rotation, the fibers 323 are transferred tangentially to roller 328 that also rotates in a counter-clockwise direction. Since roller 328 rotates faster than roller 345 and, in particular, is provided with a finer saw-tooth or trapezoidal tooth covering, the fibers are oriented in parallel and in the longitudinal direction during the transfer. After the fibers 323 are held in the covering of roller 328 for an approximate rotation of 180°, the fibers 323 are discharged tangentially upward into the air flow 306 in the channel 326.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. An arrangement of a continuous rod machine for use in the tobacco industry, comprising:

at least one filter-material feeding device comprising a metering element for dispensing metered amounts of separated filter material;

a continuous-rod forming device having a conveying direction along which a continuous filter rod is formed;

a fluidized bed for transporting the filter material from the filter material feeding device to the continuous rod-forming device;

a suction belt conveyor for compiling the filter material received from the fluidized bed, said suction belt conveyor moving in the conveying direction of the continuous rod device; and a format belt on which compiled filter material is deposited as a compacted fiber rod, the format belt being arranged behind the suction belt conveying in the conveying direction of the continuous rod device where the continuous rod-forming device forms a continuous fiber filter rod from the compacted fiber rod.

2. The continuous rod machine arrangement according to claim 1, wherein the filter material feeding device further comprises at least one conveying element.

3. The continuous rod machine arrangement according to claim 2, wherein the at least one conveying element comprises at least one roller.

4. The continuous rod machine arrangement according to claim 1, wherein the filter material feeding device supplies the separated fibers to the metering element.

5. The continuous rod machine arrangement according to claim 1, wherein the fluidized bed comprises a filter material directing channel.

6. The continuous rod machine arrangement according to claim 1, wherein the fluidized bed is a filter material directing channel.

7. The continuous rod machine arrangement according to claim 1, wherein the fluidized bed comprises a curved portion, initially transporting the fluidized filter material in a downward direction then transitioning to a horizontal position before subsequently directing the fluidized filter material in an upward direction.

8. The continuous rod machine arrangement according to claim 7, wherein the curve comprises an elliptical shape increasing in radius in the transporting direction.

9. The continuous rod machine arrangement according to claim 1, wherein the filter material feeding device further comprises a filter material separating device.

10. The continuous rod machine arrangement according to claim 9, wherein the filter feeding device separating device comprises a fiber crusher.

11. The continuous rod machine arrangement according to claim 10, wherein the fiber crusher comprises an element selected from the group consisting of at least one cutting drum and at least one hammer crusher and combinations thereof.

12. The continuous rod machine arrangement according to claims 9, wherein the filter material feeding device meters the filter material to the separating device.

13. The continuous rod machine arrangement according to claim 1, wherein the arrangement further comprises at least two filter material feeding devices.

* * * * *